US008205470B2

(12) United States Patent
Yoshioka et al.

(10) Patent No.: US 8,205,470 B2
(45) Date of Patent: Jun. 26, 2012

(54) INDOOR UNIT FOR AIR CONDITIONER

(75) Inventors: Shun Yoshioka, Osaka (JP); Hyunyoung Kim, Osaka (JP); Toshihiro Suzuki, Osaka (JP); Kazushige Kasai, Osaka (JP); Haruo Nakata, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 643 days.

(21) Appl. No.: 12/442,048

(22) PCT Filed: Sep. 28, 2007

(86) PCT No.: PCT/JP2007/069090

§ 371 (c)(1),
(2), (4) Date: Mar. 19, 2009

(87) PCT Pub. No.: WO2008/041656

PCT Pub. Date: Apr. 10, 2008

(65) Prior Publication Data

US 2009/0314020 A1 Dec. 24, 2009

(30) Foreign Application Priority Data

Sep. 29, 2006 (JP) ..... 2006-268735

(51) Int. Cl.
*F25B 39/02* (2006.01)
*F25B 13/00* (2006.01)

(52) U.S. Cl. ..... 62/524; 62/324.6; 62/518

(58) Field of Classification Search ..... 62/238.6, 62/324.6, 507, 426, 518, 524; 165/173, 175
See application file for complete search history.

(56) References Cited

U.S. PATENT DOCUMENTS

| | | | | |
|---|---|---|---|---|
| 7,204,096 | B2 * | 4/2007 | Iwata et al. | 62/426 |
| 2006/0010901 | A1 | 1/2006 | Iwata et al. | |

FOREIGN PATENT DOCUMENTS

| | | | | |
|---|---|---|---|---|
| JP | 63-17364 | A | | 1/1988 |
| JP | 63-231123 | A | | 9/1988 |
| JP | 2001-108308 | A | | 4/2001 |
| JP | 2001-174046 | A | | 6/2001 |
| JP | 2001-263772 | A | | 9/2001 |
| JP | 2003-139382 | A | | 5/2003 |
| JP | 2003287390 | A | * | 10/2003 |
| JP | 2005-241243 | A | | 9/2005 |
| WO | WO-2004/040204 | A1 | | 5/2004 |
| WO | WO 2004040204 | A1 | * | 5/2004 |

* cited by examiner

*Primary Examiner* — Chen Wen Jiang
(74) *Attorney, Agent, or Firm* — Birch, Stewart, Kolasch & Birch, LLP

(57) ABSTRACT

An indoor unit for a multi-directional air supply air conditioner capable of performing at least a heating operation includes: an indoor fan (39) for sucking air in an axial direction thereof and radially blowing out the air; and a heat exchange part (38), connected in a refrigerant circuit (80) and disposed to surround the indoor fan (39), for exchanging heat between the air blown out of the indoor fan (39) and refrigerant in the refrigerant circuit (80). The heat exchange part (38) includes a plurality of heat exchangers (48) separated from each other along the direction of the perimeter thereof and connected in parallel with each other in the refrigerant circuit (80).

22 Claims, 11 Drawing Sheets

INDOOR UNIT FOR AIR CONDITIONER

TECHNICAL FIELD

This invention relates to air conditioner indoor units in which an air supply part for supplying air therethrough to a room in different directions is formed.

BACKGROUND ART

Indoor units for air conditioners are conventionally known in which an air supply part for supplying air therethrough to a room in different directions is formed. In an indoor unit of such kind, air outlets constituting the air supply part are formed, for example, one along each side of the bottom of the indoor unit. An indoor unit of such kind is disclosed in Patent Document 1.

Specifically, the indoor unit in Patent Document 1 is an indoor unit capable of performing a cooling operation and a heating operation. The indoor unit includes a box-shaped casing. The casing contains a fan and a heat exchanger. The fan is a so-called turbo fan. The fan is disposed in the center of the casing. The heat exchanger is a cross-fin-and-tube heat exchanger. The heat exchanger is formed in a hollow square shape and disposed to surround the fan. In the indoor unit, air radially blown out of the fan passes through the heat exchanger surrounding the fan from four sides. Then, the air temperature-conditioned during passage through the heat exchanger is supplied through the air outlets to the room.

In indoor units of such kind, as in Patent Document 1, the heat exchanger is formed in a shape capable of surrounding the fan by bending it. In the heat exchanger having such a shape, if the refrigerant flow path is formed to traverse back and forth several times between one end and the other end of the heat exchanger, its length is too long. Therefore, the refrigerant flow path is formed to traverse back and forth once between one end and the other end of the heat exchanger. In other words, the refrigerant flow path is formed so that refrigerant having flowed therein through its inlet port flows out of its outlet port after a single forward and backward travel between one end and the other end of the heat exchanger.

Patent Document 1: Published Japanese Patent Application No. 2005-241243

DISCLOSURE OF THE INVENTION

Problem to be Solved by the Invention

Air conditioners with a multi-directional air supply indoor unit in which an air supply part is formed to supply air to a room in different directions may be configured so that their refrigerant circuits operate in a supercritical refrigeration cycle in which the high-side pressure of the refrigeration cycle is above the critical pressure of the refrigerant. In such cases, the conventional indoor unit may cause a problem that the temperature of supply air supplied through the air supply part to the room during the heating operation varies depending on location in the air supply part. This is described below.

Air conditioners whose refrigerant circuits operate in a supercritical refrigeration cycle use, for example, carbon dioxide as refrigerant. Since in the supercritical refrigeration cycle the refrigerant has a relatively low critical temperature, it reaches a supercritical state in which the high-side pressure in the refrigeration cycle is equal to or above the critical pressure of the refrigerant. In the supercritical state, the refrigerant causes no phase change even if it is cooled by the heat exchanger. Therefore, the refrigerant in the gas cooler gradually drops its temperature from the inlet port towards the outlet port as shown in FIG. 18.

Thus, for example, an indoor heat exchanger (48) of a four-directional air supply indoor unit (10) as shown in FIG. 19 exhibits, at one end (60) thereof having refrigerant inlet and outlet ports, a relatively large temperature difference between refrigerant flowing through the outer side of the heat exchanger (48) near the inlet port and refrigerant flowing through the inner side of the heat exchanger (48) near the outlet port. On the other hand, the indoor heat exchanger (48) does not exhibit, at the other end (61) thereof, such a large temperature difference between refrigerant flowing through the inner side thereof and refrigerant flowing through the outer side thereof.

Furthermore, at the end (60) exhibiting a large refrigerant temperature difference, the temperature difference between air heated by the inner side of the indoor heat exchanger (48) and refrigerant in the outer side thereof is also relatively large, thereby providing a relatively large amount of heat exchange in the outer side of the indoor heat exchanger (48). Therefore, air having passed through the indoor heat exchanger (48) and supplied through an associated air outlet (23) reaches a relatively high temperature. On the other hand, at the end (61) exhibiting a small temperature difference, the temperature difference between air heated by the inner side of the indoor heat exchanger (48) and refrigerant in the outer side thereof is not so large, thereby providing a less amount of heat exchange in the outer side of the indoor heat exchanger (48). Therefore, air supplied through an associated air outlet (23) does not reach such a high temperature. Thus, if an air conditioner with a multi-directional air supply indoor unit is configured so that its refrigerant circuit can operate in a supercritical refrigeration cycle, the temperature of supply air during the heating operation varies depending on location in the air supply part.

For the sake of reference, in air conditioners operating in a normal refrigeration cycle (subcritical refrigeration cycle), the temperature change of refrigerant in a heat exchanger (condenser) takes, as shown in FIG. 18, a form that the temperature drops in the course of transition from gas single-phase state to gas-liquid two-phase state, then becomes constant in the gas-liquid two-phase state and then drops again in the course of transition from gas-liquid two-phase state to gas single-phase state. Furthermore, in the normal refrigeration cycle, the liquid-gas two-phase region involving latent heat changes is relatively long. This means that the region in which refrigerant flows through the heat exchanger at a constant temperature is relatively long. Therefore, during the heating operation, the temperature of supply air is relatively uniform without depending on location in the air supply part.

The present invention has been made in view of the foregoing points and, therefore, an object thereof is that a multi-directional air supply indoor unit of an air conditioner, in which a refrigerant circuit operates in a refrigeration cycle in which the high-side pressure is equal to or above the critical pressure of the refrigerant, can reduce that the temperature of supply air varies depending on location in an air supply part.

Means to Solve the Problem

A first aspect of the invention is directed to an indoor unit (10) for an air conditioner, the indoor unit including: an indoor fan (39) for sucking air in an axial direction thereof and radially blowing out the air; a heat exchange part (38), connected in a refrigerant circuit (80) and disposed to surround the indoor fan (39), for exchanging heat between the air blown out of the indoor fan (39) and refrigerant in the refrigerant circuit (80); and a casing (34) containing the indoor fan (39) and the heat exchange part (38) and having an air supply part (16) formed therein to supply air to a room in different directions, wherein the refrigerant circuit (80) is operable in a refrigeration cycle in which the high-side pressure is equal to or above the critical pressure of the refrigerant, and the indoor unit (10) is capable of performing a heating operation in which the heat exchange part (38) serves as a gas cooler in the refrigerant circuit (80). In this indoor unit (10) for an air conditioner, the heat exchange part (38) includes a plurality of heat exchangers (48) separated from each other along a direction of the perimeter of the heat exchange part (38) and connected in parallel with each other in the refrigerant circuit (80).

A second aspect of the invention is directed to an indoor unit (10) for an air conditioner, the indoor unit including: an indoor fan (39) for sucking air in an axial direction thereof and radially blowing out the air; a heat exchange part (38), connected in a refrigerant circuit (80) and disposed to surround the indoor fan (39), for exchanging heat between the air blown out of the indoor fan (39) and refrigerant in the refrigerant circuit (80); and a casing (34) containing the indoor fan (39) and the heat exchange part (38) and having four air outlets (23) formed therein to supply air to a room in respective different directions, wherein the indoor unit (10) is capable of performing a heating operation in which the heat exchange part (38) serves as a gas cooler. In this indoor unit (10) for an air conditioner, the heat exchange part (38) includes a plurality of heat exchangers (48) separated from each other along a direction of the perimeter of the heat exchange part (38) and connected in parallel with each other in the refrigerant circuit (80).

A third aspect of the invention is the indoor unit according to the first or second aspect of the invention, wherein each of the heat exchangers (48) constituting the heat exchange part (38) includes a refrigerant flow path (45) formed therein to meander back and forth a plurality of times between one end and the other end of the heat exchanger (48).

A fourth aspect of the invention is the indoor unit according to the third aspect of the invention, wherein each of the heat exchangers (48) includes a plurality of the refrigerant flow paths (45) connected in parallel with each other.

A fifth aspect of the invention is the indoor unit according to the third or fourth aspect of the invention, wherein each of the heat exchangers (48) includes a plurality of the refrigerant flow paths (45) arranged in the axial direction of the indoor fan (39).

A sixth aspect of the invention is directed to an indoor unit (10) for an air conditioner, the indoor unit including: an indoor fan (39) for sucking air in an axial direction thereof and radially blowing out the air; a heat exchange part (38), connected in a refrigerant circuit (80) and disposed to surround the indoor fan (39), for exchanging heat between the air blown out of the indoor fan (39) and refrigerant in the refrigerant circuit (80); and a casing (34) containing the indoor fan (39) and the heat exchange part (38) and having an air supply part (16) formed therein to supply air to a room in different directions, wherein the refrigerant circuit (80) is operable in a refrigeration cycle in which the high-side pressure is equal to or above the critical pressure of the refrigerant, and the indoor unit (10) is capable of performing a heating operation in which the heat exchange part (38) serves as a gas cooler in the refrigerant circuit (80). In this indoor unit (10) for an air conditioner, the heat exchange part (38) includes a plurality of refrigerant flow paths (45) connected in parallel with each other in the refrigerant circuit (80) to extend in a direction of the perimeter of the heat exchange part (38) and arranged alongside each other in the axial direction of the indoor fan (39), and during the heating operation, the direction of refrigerant flowing into a first flow path (45*a*) constituting part of the plurality of refrigerant flow paths (45) is opposite to the direction of refrigerant flowing into a second flow path (45*b*) constituting the remaining part of the plurality of refrigerant flow paths (45) with reference to the direction of the perimeter of the heat exchange part (38).

A seventh aspect of the invention is the indoor unit according to the sixth aspect of the invention, wherein the first and second flow paths (45*a*, 45*b*) are formed in equal numbers in the heat exchange part (38).

An eighth aspect of the invention is the indoor unit according to the sixth or seventh aspect of the invention, wherein in the heat exchange part (38) the first and second flow paths (45*a*, 45*b*) are alternated in the axial direction of the indoor fan (39).

A ninth aspect of the invention is the indoor unit according to the sixth or seventh aspect of the invention, wherein in the heat exchange part (38) one or more of the first flow paths (45*a*) are disposed towards one axial end of the indoor fan (39) and one or more of the second flow paths (45*b*) are disposed towards the other axial end of the indoor fan (39).

A tenth aspect of the invention is the indoor unit according to any one of the sixth to ninth aspects of the invention, wherein the heat exchange part (38) includes one or more heat exchangers (48) in which both the first and second flow paths (45*a*, 45*b*) are formed.

An eleventh aspect of the invention is the indoor unit according to any one of the sixth to ninth aspects of the invention, wherein the heat exchange part (38) includes a first heat exchanger (48*a*) having only the first flow path (45*a*) formed therein and a second heat exchanger (48*b*) having only the second flow path (45*b*) formed therein, and in the heat exchange part (38) the first heat exchanger (48*a*) and the second heat exchanger (48*b*) are disposed adjacent each other in the axial direction of the indoor fan (39).

A twelfth aspect of the invention is the indoor unit according to any one of the first to eleventh aspects of the invention, wherein a refrigerant flow path (45) is formed in the heat exchange part (38) so that an inlet end thereof during the heating operation is located in the side of the heat exchange part (38) away from the indoor fan (39) and an outlet end thereof during the heating operation is located in the side of the heat exchange part (38) towards the indoor fan (39).

A thirteenth aspect of the invention is the indoor unit according to any one of the first to twelfth aspects of the invention, wherein the heat exchange part (38) includes two heat exchangers (48) each formed in the shape of the letter L when viewed in the axial direction of the indoor fan (39).

A fourteenth aspect of the invention is the indoor unit according to the thirteenth aspect of the invention, wherein the air supply part (16) includes four air outlets (23), one formed along each side of the L-shape of each of the L-shaped heat exchangers (48), and the air supply part (16) is configured to supply through each of the air outlets (23) air having passed through part of the heat exchanger (48) located along the air outlet (23).

A fifteenth aspect of the invention is the indoor unit according to the fourteenth aspect of the invention, wherein the refrigerant circuit (80) is filled with carbon dioxide as the refrigerant.

A sixteenth aspect of the invention is the indoor unit according to any one of the first to twelfth aspects of the invention, wherein the heat exchange part (38) includes four heat exchangers (48) each formed in the shape of a panel.

A seventeenth aspect of the invention is the indoor unit according to the sixteenth aspect of the invention, wherein the air supply part (16) includes four air outlets (23), one formed along each of the heat exchangers (48), and the air supply part (16) is configured to supply through each of the air outlets (23) air having passed through the heat exchanger (48) located along the air outlet (23).

An eighteenth aspect of the invention is the indoor unit according to the seventeenth aspect of the invention, wherein the refrigerant circuit (80) is filled with carbon dioxide as the refrigerant.

A nineteenth aspect of the invention is the indoor unit according to any one of the first to eighteenth aspects of the invention, wherein the air supply part (16) includes a single air outlet (23) formed along the entire perimeter of the heat exchange part (38).

A twentieth aspect of the invention is the indoor unit according to any one of the first to twelfth aspects of the invention, wherein the heat exchange part (38) includes two heat exchangers (48) each formed in the shape of the letter L when viewed in the axial direction of the indoor fan (39), and the air supply part (16) includes a single air outlet (23) formed along the entire perimeter of the heat exchange part (38).

A twenty-first aspect of the invention is the indoor unit according to the twentieth aspect of the invention, wherein the refrigerant circuit (80) is filled with carbon dioxide as the refrigerant.

A twenty-second aspect of the invention is the indoor unit according to any one of the first to twelfth aspects of the invention, wherein the heat exchange part (38) includes four heat exchangers (48) each formed in the shape of a panel, and the air supply part (16) includes a single air outlet (23) formed along the entire perimeter of the heat exchange part (38).

A twenty-third aspect of the invention is the indoor unit according to the twenty-second aspect of the invention, wherein the refrigerant circuit (80) is filled with carbon dioxide as the refrigerant.

—Operations—

In the first aspect of the invention, the heat exchange part (38) includes a plurality of heat exchangers (48) separated from each other along the direction of the perimeter thereof and connected in parallel with each other in the refrigerant circuit (80). In other words, the indoor fan (39) is surrounded by the plurality of heat exchangers (48). Since the heat exchangers (48) are connected in parallel with each other in the refrigerant circuit (80), the respective mean values of temperatures of air heated by the heat exchangers (48) are relatively close to each other. Then, the respective flows of air heated by the heat exchangers (48) are blown out through the air supply part (16).

In the second aspect of the invention, the heat exchange part (38) includes a plurality of heat exchangers (48) separated from each other along the direction of the perimeter thereof and connected in parallel with each other in the refrigerant circuit (80). In other words, the indoor fan (39) is surrounded by the plurality of heat exchangers (48). Since the heat exchangers (48) are connected in parallel with each other in the refrigerant circuit (80), the respective mean values of temperatures of air heated by the heat exchangers (48) are relatively close to each other. Then, the respective flows of air heated by the heat exchangers (48) are blown out through the respective air outlets (23).

In the third aspect of the invention, the refrigerant having flowed into the refrigerant flow path (45) travels back and forth the plurality of times between one end and the other end of the heat exchanger (48) and then flows out of the heat exchanger (48). Therefore, the degree of temperature drop of refrigerant per single forward and backward travel between one end and the other end of the heat exchanger (48) is reduced as compared to the case where the refrigerant flow path (45) is formed to traverse back and forth only once between one end and the other end of the heat exchanger (48). Thus, in terms of per single forward and backward travel of refrigerant, the temperature difference of refrigerant between one end and the other end of the heat exchanger (48) is reduced.

In the fourth aspect of the invention, a plurality of refrigerant flow paths (45) connected in parallel with each other are formed in each heat exchanger (48). In each heat exchanger (48), the respective mean values of temperatures of air heated by the refrigerant flow paths (45) are relatively close to each other.

In the fifth aspect of the invention, a plurality of refrigerant flow paths (45) arranged in the axial direction of the indoor fan (39) are formed in each heat exchanger (48). Air passing through each heat exchanger (48) is heated by refrigerant flowing through each refrigerant flow path (45) in the heat exchanger (48) during the heating operation.

In the sixth aspect of the invention, the heat exchange part (38) includes a region in which a plurality of refrigerant flow paths (45) parallel-connected in the refrigerant circuit (80) are arranged alongside each other in the axial direction of the indoor fan (39). Furthermore, in the above region, the direction of refrigerant flowing into a first flow path (45*a*) constituting part of the plurality of refrigerant flow paths (45) during the heating operation is opposite to the direction of refrigerant flowing into a second flow path (45*b*) constituting the remaining part of the plurality of refrigerant flow paths (45) during the heating operation with reference to the direction of the perimeter of the heat exchange part (38). In other words, in the above region during the heating operation, refrigerant flows through one end of the heat exchange part (38) into the first flow path (45*a*) while refrigerant flows through the other end thereof into the second flow path (45*b*). Therefore, high-temperature refrigerant flows just after flowing into the refrigerant flow paths (45) flow at both ends of the above region during the heating operation.

In the seventh aspect of the invention, the first and second flow paths (45*a*, 45*b*) are formed in equal numbers in the region in which a plurality of refrigerant flow paths (45) parallel-connected in the refrigerant circuit (80) are arranged alongside each other in the axial direction of the indoor fan (39). Therefore, one end and the other end of the above region have equal numbers of refrigerant inlet ports of the first or second flow paths (45*a*, 45*b*) during the heating operation.

In the eighth aspect of the invention, the first and second flow paths (45*a*, 45*b*) are alternated along the axial direction of the indoor fan (39) in the region in which a plurality of refrigerant flow paths (45) parallel-connected in the refrigerant circuit (80) are arranged alongside each other in the axial direction of the indoor fan (39). Therefore, at each end of the above region, the refrigerant flow paths (45) whose refrigerant inlet ports during the heating operation are at the end of the region and the refrigerant flow paths (45) whose refrigerant inlet ports during the heating operation are not at the end thereof are alternated along the axial direction of the indoor fan (39).

In the ninth aspect of the invention, within the region in which a plurality of refrigerant flow paths (45) parallel-connected in the refrigerant circuit (80) are arranged alongside each other in the axial direction of the indoor fan (39), one or more first flow paths (45*a*) are disposed towards one axial end of the indoor fan (39) and one or more second flow paths (45*b*) are disposed towards the other axial end of the indoor fan (39). In the case where both the first flow path (45*a*) and the second flow path (45*b*) are plural in number, the first flow paths (45*a*) are collectively disposed on one side in the axial direction of the indoor fan (39) and the second flow paths (45*b*) are collectively disposed on the other side in the axial direction of the indoor fan (39).

In the tenth aspect of the invention, the heat exchange part (38) includes one or more heat exchangers (48) in which both the first and second flow paths (45*a*, 45*b*) are formed. In the heat exchanger (48) during the heating operation, refrigerant flows from one end towards the other end thereof into the first flow path (45*a*) while refrigerant flows from the other end towards the one end thereof into the second flow path (45*b*).

In the eleventh aspect of the invention, a first heat exchanger (48*a*) having only the first flow path (45*a*) formed therein and a second heat exchanger (48*b*) having only the second flow path (45*b*) formed therein are disposed adjacent each other in the axial direction of the indoor fan (39). Therefore, the first flow path (45*a*) and the second flow path (45*b*) are formed in different heat exchangers (48*a*, 48*b*) of the heat exchange part (38).

In the twelfth aspect of the invention, the inlet end of the refrigerant flow path (45) during the heating operation is located away from the indoor fan (39) and the outlet end thereof is located towards the indoor fan (39). In other words, in the refrigerant flow path (45), high-temperature refrigerant flows through the side thereof near the inlet port and away from the indoor fan (39) and low-temperature refrigerant flows through the side thereof near the outlet port and towards the indoor fan (39).

In the thirteenth aspect of the invention, two heat exchangers (48) constituting the heat exchange part (38) are each formed in the shape of the letter L when viewed in the axial direction of the indoor fan (39). Therefore, the heat exchanger (48) is formed simply by bending it at a single point.

In the fourteenth and twentieth aspects of the invention, air having passed through one of the two sides of the L-shape of each heat exchanger (48) is supplied through the air outlet (23) located along the one side thereof and air having passed through the other side thereof is supplied through the air outlet (23) located along the other side thereof. The temperatures of air flows having passed through one sides of the L-shapes of the two heat exchangers (48) and blown out through the associated air outlets (23) are relatively close to each other and the temperatures of air flows having passed through the other sides thereof and blown out through the associated air outlets (23) are also relatively close to each other. In other words, out of the four air outlets (23), the temperatures of supply air through two air outlets (23) through which air flows having passed through one sides of the L-shapes of the heat exchangers (48) are supplied are relatively close to each other and the temperatures of supply air through the remaining two air outlets (23) through which air flows having passed through the other sides thereof are supplied are also relatively close to each other.

In the fifteenth, eighteenth, twenty-first and twenty-third aspects of the invention, carbon dioxide is used as the refrigerant. The refrigerant circuit (80) operates in a refrigeration cycle in which the high-side pressure is equal to or above the critical pressure of carbon dioxide.

In the sixteenth and twenty-second aspects of the invention, four heat exchangers (48) constituting the heat exchange part (38) are each formed in the shape of a panel. Therefore, there is no need to bend each heat exchanger (48).

In the seventeenth aspect of the invention, since the four heat exchangers (48) are connected in parallel with each other in the refrigerant circuit (80), the respective temperatures of air having passed through the heat exchangers (48) are relatively close to each other. Then, the air having passed through each heat exchanger (48) is supplied to a room through the air outlet (23) located along the heat exchanger (48). Therefore, the respective temperatures of air supplied through the air outlets (23) are relatively close to each other.

In the nineteenth, twenty and twenty-second aspects of the invention, the air supply part (16) includes a single air outlet (23) formed along the entire perimeter of the heat exchange part (38). Therefore, the indoor unit (10) has a wider air supply area than that in which the air supply part (16) formed along the perimeter of the heat exchange part (38) is divided into four air outlets (23), one along each side of the bottom of the casing (34).

Effects of the Invention

According to the first aspect of the invention, the respective mean values of temperatures of air heated by the plurality of heat exchangers (48) surrounding the indoor fan (39) are relatively close to each other. In other words, out of air flows having passed through the heat exchange part (38), air flows having passed through different heat exchangers (48) have a relatively small temperature difference. In addition, the heat exchangers (48) are formed by dividing the heat exchange part (38) along the direction of the perimeter thereof. Therefore, it can be avoided that the temperature of air having passed through the heat exchange part (38) gradually changes along the perimeter of the heat exchanger part (38) as has been done in the past and there are locations of the same temperature along the perimeter of the heat exchange part (38). Hence, it can be reduced that the temperature of supply air varies depending on location in the air supply part (16). Furthermore, it can be reduced that the temperature of supply air to which persons in the room are exposed varies depending on location in the room, which enhances the comfortability of the persons in the room.

According to the second aspect of the invention, the respective mean values of temperatures of air heated by the plurality of heat exchangers (48) surrounding the indoor fan (39) are relatively close to each other. In other words, out of air flows having passed through the heat exchange part (38), air flows having passed through different heat exchangers (48) have a relatively small temperature difference. In addition, the heat exchangers (48) are formed by dividing the heat exchange part (38) along the direction of the perimeter thereof. Therefore, it can be avoided that the temperature of air having passed through the heat exchange part (38) gradually changes along the perimeter of the heat exchanger part (38) as has been done in the past and there are locations of the same temperature along the perimeter of the heat exchange part (38). Hence, it can be reduced that the temperature of supply air varies depending on the air outlets (23). Furthermore, it can be reduced that the temperature of supply air to which persons in the room are exposed varies depending on location in the room, which enhances the comfortability of the persons in the room.

According to the third aspect of the invention, in terms of per single forward and backward travel of refrigerant, the temperature difference of refrigerant between one end and the other end of the heat exchanger (48) is reduced. Thus, the temperature difference between air heated at one end of the heat exchanger (48) and air heated at the other end thereof is reduced. Therefore, it can be reduced that the temperature of supply air varies depending on location in the air supply part (16).

According to the fourth aspect of the invention, the respective mean values of temperatures of air heated by the refrigerant flow paths (45) of each heat exchanger (48) are relatively close to each other. Therefore, out of air flows having passed through one heat exchanger (48), air flows having passed through different refrigerant flow paths (45) have a relatively small temperature difference. Hence, it can be reduced that the temperature of air having passed through the heat exchanger (48) varies depending on location in the heat exchanger (48) where the air has passed.

According to the sixth to eleventh aspects of the invention, during the heating operation, high-temperature refrigerant flows just after flowing into the plurality of refrigerant flow paths (45) parallel-connected in the refrigerant circuit (80) flow at both ends of the region in which the plurality of refrigerant flow paths (45) are arranged alongside each other in the axial direction of the indoor fan (39). In this relation, in the conventional case where in the above region during the heating operation all the refrigerant flow paths (45) have the same direction of inflow of refrigerant, high-temperature refrigerant flows during the heating operation flow only at one of both ends of the above region. Thus, during the heating operation, a relatively large temperature difference is found between air having passed through the one end of the above region and air having passed through the other end thereof and, therefore, the temperature of supply air varies depending on location in the air supply part (16). Unlike the above case, according to the sixth to eleventh aspects of the invention, since high-temperature refrigerant flows just after flowing into the refrigerant flow paths (45) flow at both ends of the above region, a less temperature difference is found between air having passed through one end of the above region and air having passed through the other end of the above region. Therefore, it can be reduced that the temperature of supply air varies depending on location in the air supply part (16). Furthermore, it can be reduced that the temperature of supply air to which persons in the room are exposed varies depending on location in the room, which enhances the comfortability of the persons in the room.

According to the seventh aspect of the invention, one end and the other end of the above region have equal numbers of refrigerant inlet ports of the first or second flow paths (45*a*, 45*b*) during the heating operation. Therefore, the temperature difference between air having passed through one end of the above region and air having passed through the other end thereof can be further reduced, which reduces variation in the temperature of supply air depending on location in the air supply part (16).

According to the eighth aspect of the invention, at each end of the above region, the refrigerant flow paths (45) whose refrigerant inlet ports during the heating operation are at the end of the region and the refrigerant flow paths (45) whose refrigerant inlet ports during the heating operation are not at the end thereof are alternated along the axial direction of the indoor fan (39). Therefore, during the heating operation, at each end of the above region, relatively high-temperature air having passed around the refrigerant flow paths (45) whose refrigerant inlet ports are at the end of the above region is easily mixed with less high-temperature air having passed around the refrigerant flow paths (45) whose refrigerant inlet ports are not at the end thereof, which makes the temperature of supply air uniform.

According to the eleventh aspect of the invention, the first flow path (45*a*) and the second flow path (45*b*) are formed in different heat exchangers (48*a*, 48*b*) of the heat exchange part (38). If the first flow path (45*a*) and the second flow path (45*b*) are formed in the same heat exchanger (48), two types of refrigerant flow paths (45) must be formed in a single heat exchanger (48), which complicates the process of producing the heat exchanger (48). In contrast, in the eleventh aspect of the invention, the first flow path (45*a*) and the second flow path (45*b*) are formed in different heat exchangers (48*a*, 48*b*). Therefore, a single type of refrigerant flow path (45) is formed in each heat exchanger (48*a*, 48*b*), which avoids complication of the process of producing each heat exchanger (48*a*, 48*b*).

According to twelfth aspect of the invention, high-temperature refrigerant flows through the side of the refrigerant flow path (45) near the inlet port and away from the indoor fan (39) and low-temperature refrigerant flows through the side thereof near the outlet port and towards the indoor fan (39). Therefore, even after being heated by the side of the heat exchanger (48) towards the indoor fan (39), air passing through the heat exchanger (48) can keep a temperature difference from refrigerant flowing through the side of the heat exchanger (48) away from the indoor fan (39). Thus, the amount of heat exchange between air and refrigerant on the side of the heat exchanger (48) away from the indoor fan (39) becomes relatively large. This increases the amount of heat exchange between air and refrigerant in the heat exchanger (48), which enhances the operating efficiency of the air conditioner.

According to the thirteenth aspect of the invention, the heat exchanger (48) is formed simply by bending it at a single point. In a supercritical refrigeration cycle, generally, the high-side pressure of the refrigeration cycle is much higher than that in a normal refrigeration cycle. Therefore, a thick heat exchanger tube is used for a heat exchanger (48) for use in the supercritical refrigeration cycle. This makes the bending work of the heat exchanger (48) difficult when the heat exchanger (48) is formed in a hollow square shape as has been done in the past. Unlike this, since in the thirteenth aspect of the invention there is no need to bend the heat exchanger (48), the heat exchange part (38) can be easily formed.

According to the fourteenth and twentieth aspects of the invention, out of the four air outlets (23), the temperatures of supply air through two air outlets (23) are relatively close to each other and the temperatures of supply air through the remaining two air outlets (23) are also relatively close to each other. Therefore, the temperature of supply air does not vary among the four air outlet (23) unlike the conventional air conditioners. Hence, it can be reduced that the temperature of supply air varies depending on the air outlets (23).

According to the sixteenth and twenty-second aspects of the invention, there is no need to bend each heat exchanger (48). In a supercritical refrigeration cycle, generally, the high-side pressure of the refrigeration cycle is much higher than that in a normal refrigeration cycle. Therefore, a thick heat exchanger tube is used for a heat exchanger (48) for use in the supercritical refrigeration cycle. This makes the bending work of the heat exchanger (48) difficult when the heat exchanger (48) is formed in a hollow square shape as has been done in the past. Unlike this, since in the sixteenth and twenty-second aspects of the invention there is no need to bend the heat exchanger (48), the heat exchange part (38) can be easily formed.

According to the seventeenth aspect of the invention, the respective temperatures of air supplied through the air outlets (23) become relatively close to each other by supplying through the air outlet (23) located along each heat exchanger (48) air having passed through the heat exchanger (48). Hence, it can be reduced that the temperature of supply air varies depending on the air outlets (23).

According to the nineteenth, twentieth and twenty-second aspects of the invention, the indoor unit (10) has a wider air supply area than that in which the air supply part (16) formed along the perimeter of the heat exchange part (38) is divided into four air outlets (23), one along each side of the bottom of the casing (34). Thus, the wind speed of air supplied through the air outlet (23) can be reduced, which reduces the sound of air supply and thereby enhances the comfortability of persons in the room in terms of quietness. Furthermore, the wind speed of air which is supplied through the air outlet (23) and to which persons in the room are exposed can be reduced, which enhances the comfortability of persons in the room also in terms of feeling of draft.

LIST OF REFERENCE NUMERALS

Figure 1:
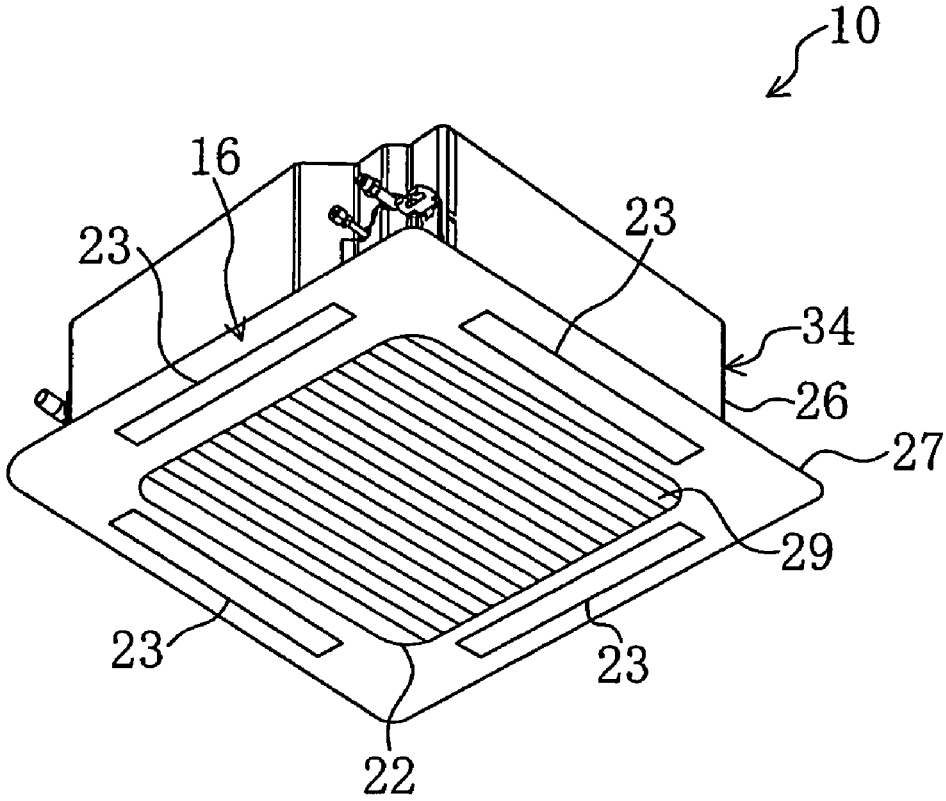
FIG. 1 is a perspective view of an indoor unit of an air conditioner according to Embodiment 1 of the present invention when viewed from a room.

10 indoor unit
16 air supply part
23 air outlet
34 casing
38 heat exchange part
39 indoor fan
45 refrigerant flow path
45*a* first flow path
45*b* second flow path
48 heat exchanger
48*a* first heat exchanger
48*b* second heat exchanger
80 refrigerant circuit

BEST MODE FOR CARRYING OUT THE INVENTION

Embodiments of the present invention will be described below in detail with reference to the drawings.

Embodiment 1 of the Invention

Embodiment 1 of the present invention will be described. Embodiment 1 is an indoor unit (10) of an air conditioner according to the present invention. The indoor unit (10) of the air conditioner of Embodiment 1 is, as shown in FIG. 1, a four-directional air supply indoor unit (10) in which four air outlets (23) are formed, one along each side of a decorative panel (27). The four air outlets (23) constitute an air supply part (16).

Figure 2:
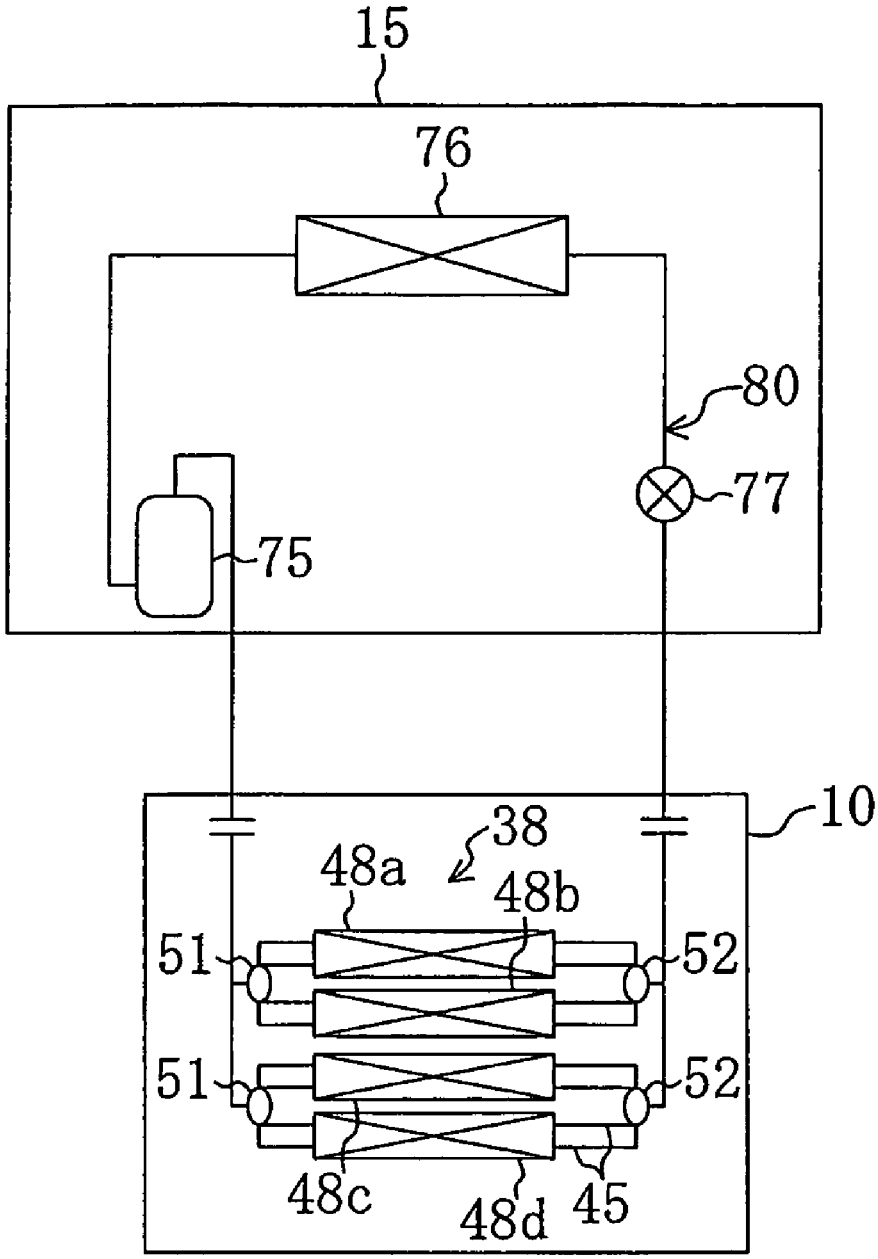
FIG. 2 is a schematic diagram of a refrigerant circuit of the air conditioner according to Embodiment 1 of the present invention.

As shown in FIG. 2, the indoor unit (10) is connected, together with an outdoor unit (15) containing a compressor (75), an outdoor heat exchanger (76) and an expansion valve (77), in a refrigerant circuit (80). The refrigerant circuit (80) is filled with carbon dioxide as refrigerant. The air conditioner is configured to be capable of performing a heating operation. The air conditioner, however, may be configured to be capable of selectively performing a heating operation and a cooling operation by providing the refrigerant circuit (80) with a four-way selector valve or the like.

Figure 3:
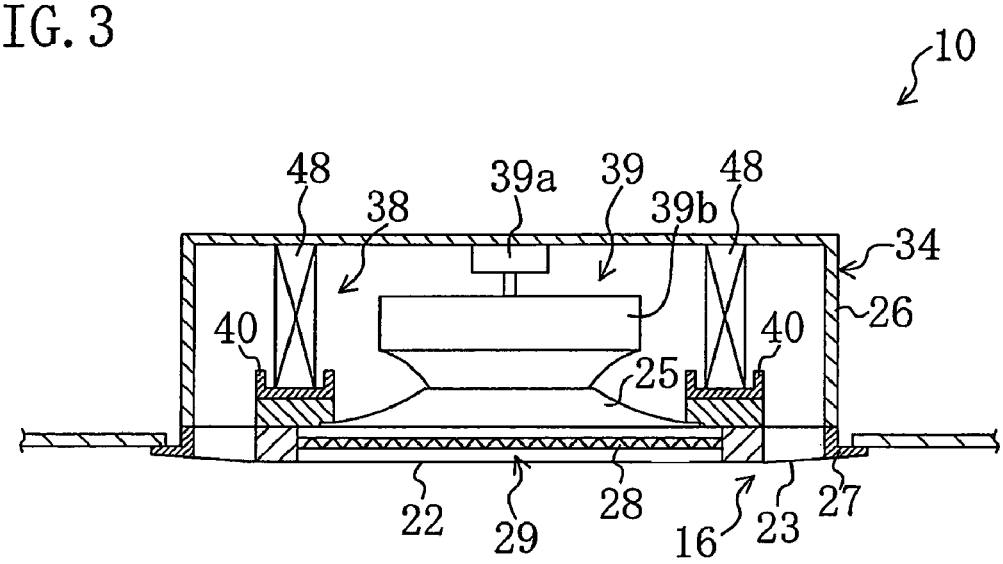
FIG. 3 is a cross-sectional view of the indoor unit of the air conditioner according to Embodiment 1 of the present invention.

The indoor unit (10) includes a casing (34) including a casing body (26) and the decorative panel (27). As shown in FIG. 3, the casing body (26) is formed in the shape of a box and contains an indoor fan (39), a heat exchange part (38) and a drain pan (40). The decorative panel (27) is attached to the bottom of the casing body (26) to cover it. When attached to the casing body (26), the decorative panel (27) is exposed to the room.

The indoor fan (39) is a so-called turbo fan. The indoor fan (39) is disposed near the center of the casing body (26) and located above the later-described air inlet (22). The indoor fan (39) includes a fan motor (39*a*) and an impeller (39*b*). The fan motor (29*a*) is fixed to the top plate of the casing body (26). The impeller (39*b*) is coupled to the rotary shaft of the fan motor (39*a*). Provided below the indoor fan (39) is a bell mouth (25) communicated with the air inlet (22). The indoor fan (39) is configured to suck air through the bell mouth (25) from below and radially blow out the sucked air.

Figure 4:
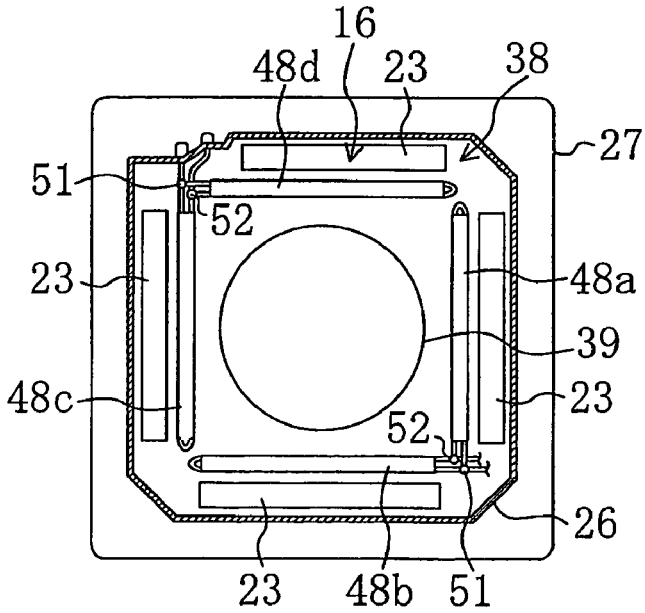
FIG. 4 is a plan view of the interior of the indoor unit of the air conditioner according to Embodiment 1 of the present invention.

The heat exchange part (38) is, as shown in FIG. 4, disposed to surround the indoor fan (39). The heat exchange part (38) is separated at four corners of its perimeter into four heat exchangers (48*a*, 48*b*, 48*c*, 48*d*). The heat exchangers (48) are disposed, one on each of four sides of the indoor fan (39). The four heat exchangers (48*a*, 48*b*, 48*c*, 48*d*) are connected in parallel with each other in the refrigerant circuit (80).

Figure 5:
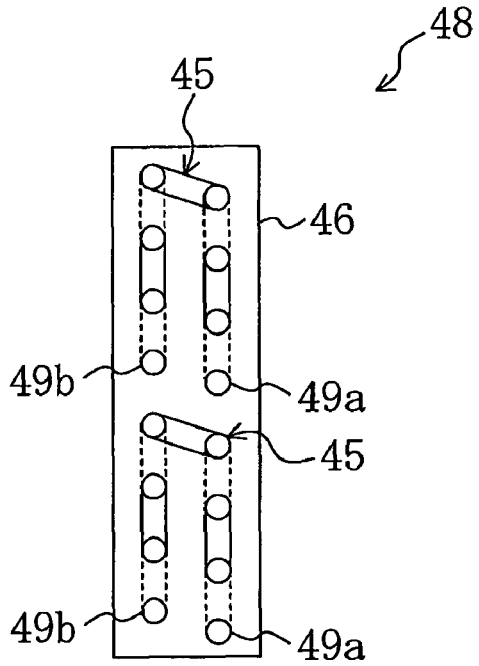
FIG. 5 is a front view of an end of a heat exchanger near refrigerant ports thereof in the indoor unit of the air conditioner according to Embodiment 1 of the present invention.

Each heat exchanger (48) is a cross-fin type fin-and-tube heat exchanger. Each heat exchanger (48) is formed in the shape of a panel. Each heat exchanger (48) is, as shown in FIG. 5, provided with two refrigerant flow paths (45, 45). In each heat exchanger (48), the two refrigerant flow paths (45, 45) are connected in parallel with each other. Furthermore, in each heat exchanger (48), the two refrigerant flow paths (45, 45) are alongside each other in the axial direction of the indoor fan (39).

Each refrigerant flow path (45) is formed by connecting four U-shaped heat exchanger tubes. Each refrigerant flow path (45) meanders back and fourth four times between one end and the other end of the heat exchanger (48).

Specifically, each refrigerant flow path (45) is formed by inserting two U-shaped heat exchanger tubes in each of one lateral end and the other lateral end portions of each fin (46) of the heat exchanger (48) to vertically align their straight tube parts with each other and then connecting ends of each adjacent two U-shaped heat exchanger tubes by a semi-circular heat exchanger tube. Such a semi-circular heat exchanger tube is connected between the upper end of the upper U-shaped heat exchanger tube located at one lateral end portions of the fins and the upper end of the upper U-shaped heat exchanger tube located at the other lateral end portions of the fins. Furthermore, a semi-circular heat exchanger tube is connected at each of one lateral end and the other lateral end portions of the fin between the lower end of the upper U-shaped heat exchanger tube and the upper end of the lower U-shaped heat exchanger tube. The lower ends of the lower U-shaped heat exchanger tubes located at one lateral end and the other lateral end portions of the fins are not connected by a semi-circular heat exchanger tube and thereby provide refrigerant ports (49*a*, 49*b*). Both the two refrigerant ports (49*a*, 49*b*) are located at one end of the heat exchanger (48).

In each of the refrigerant flow paths (45, 45), the U-shaped heat exchanger tubes located at one lateral end portions of the fins are offset slightly below from those located at the other lateral end portions of the fins so that the straight tube parts of the U-shaped heat exchanger tubes at one lateral end portions of the fins do not overlap with the straight tube parts of the U-shaped heat exchanger tubes at the other lateral end portions of the fins when viewed from the side. In short, the arrangement of the straight tube parts of the U-shaped heat exchanger tubes is a so-called staggered arrangement.

Out of the four corners of the casing body (26), two in a diagonal relationship are each provided with one header (51) and one flow divider (52). Refrigerant pipes extending from the headers (51) are combined with each other inside the casing body (26) and connected to a gas-side connection port (not shown) formed in a side surface of the casing body (26). Refrigerant pipes extending from the flow dividers (52) are combined with each other inside the casing body (26) and connected to a liquid-side connection port (not shown) formed in a side surface of the casing body (26). In the refrigerant circuit (80), the headers (51) are located closer to the compressor (75) than the heat exchange part (38) and the flow dividers (52) are located closer to the expansion valve (77) than the heat exchanger part (38).

Two of the four heat exchangers (48) are disposed so that their ends having refrigerant ports (49*a*, 49*b*) face one of the two headers (51) and one of the two flow dividers (52), while the remaining two are disposed so that their ends having refrigerant ports (49*a*, 49*b*) face the other header (51) and the other flow divider (52). In each of the two refrigerant flow paths (45, 45) of each heat exchanger (48), the refrigerant port (49*a*) in one lateral end portion of the fin is connected to the associated header (51) and the refrigerant port (49*b*) in the other lateral end portion thereof is connected to the associated flow divider (52). Furthermore, each heat exchanger (48) is disposed so that the one lateral end portions of the fins (46) are located away from the indoor fan (39) and the other lateral end portions thereof are located towards the indoor fan (39).

The drain pan (40) is disposed below the heat exchange part (38). The drain pan (40) is configured to receive drain water produced in the heat exchange part (38) by condensation of moisture in the air. The drain pan (40) is provided with a drain pump (not shown) for pumping out drain water. The drain pan (40) is sloped so that drain water is collected at a point where the drain pump is disposed.

Formed in the decorative panel (27) are one air inlet (22) and four air outlets (23, 23, 23, 23). The air inlet (22) is formed near the center of the decorative panel (27). Placed behind the air inlet (22) is a filter (28) for removing dust in inlet air. Fitted in the air inlet (22) is an inlet grill (29) having a plurality of slits formed therein. Each air outlet (23) is formed outwardly of the air inlet (22). Each air outlet (23) is located below and between the associated heat exchanger (48) and the opposed sidewall of the casing body (26) and disposed along the heat exchanger (48).

—Operational Behavior of Air Conditioner—

A description is given of the operational behavior of the air conditioner according to Embodiment 1 during the heating operation. When the compressor (30) is activated, the air conditioner according to Embodiment 1 starts the heating operation. In the heating operation, the opening of the expansion valve (36) is appropriately adjusted.

In the heating operation, the refrigerant circuit (80) operates in a refrigeration cycle in which the outdoor heat exchanger (76) serves as an evaporator and the heat exchanger (48) in the indoor unit (10) serves as a gas cooler (radiator). In the refrigeration cycle, the high-side pressure of the refrigeration cycle is above the critical pressure of carbon dioxide.

Specifically, refrigerant discharged from the compressor (30) is branched in the indoor unit (10) and the branched refrigerant flows flow into the headers (51). The refrigerant flow having flowed in each header (51) is distributed to the four refrigerant flow paths (45), two for each of the two heat exchangers (48).

In each refrigerant flow path (45), refrigerant flows therein through the port (49*a*) located in one lateral end portion of the fin (46) of the heat exchanger (48), flows through the four straight tube parts at the one lateral end portions of the fins (46) in order from the lowermost straight tube part, then flows through the four straight tube parts at the other lateral end portions of the fins (46) in order from the uppermost straight tube part, and then flows out thereof through the port (49*b*) located in the other lateral end portion of the fin (46). During the passage through the refrigerant flow path (45), the refrigerant flowing therethrough is cooled by heat exchange with air blown out of the indoor fan (39) and passing through the heat exchanger (48) from inward to outward.

On the other hand, air passing through each heat exchanger (48) is heated by the refrigerant. Since the heat exchangers (48) are parallel-connected to the refrigerant circuit (80), the respective temperatures of air heated by the heat exchangers (48) are approximately equal to each other. Although air just after passing through each heat exchanger (48) has a vertical temperature distribution, the air is immediately mixed to reach a uniform temperature. Then, the air heated by the heat exchanger (48) and having a uniform temperature is blown out through the air outlet (23) formed along the heat exchanger (48).

In each refrigerant flow path (45), high-temperature refrigerant flows through the side thereof near the inlet port and away from the indoor fan (39) and low-temperature refrigerant flows through the side thereof near the outlet port and towards the indoor fan (39). Therefore, even after being heated by the side of each heat exchanger (48) towards the indoor fan (39), air passing through the heat exchanger (48) has a relatively large temperature difference from refrigerant flowing through the side of the heat exchanger (48) away from the indoor fan (39), thereby being efficiently heated.

The refrigerant flow cooled in each refrigerant flow path (45) flows in the associated flow divider (52) to meet the refrigerant flow cooled in another refrigerant flow path (45), then meets also the refrigerant flow having flowed out of the other flow divider (52) and then flows out of the indoor unit (10). The refrigerant having flowed out of the indoor unit (10) is reduced in pressure during the passage through the expansion valve (77) in the outdoor unit (15) and then exchanges heat with outdoor air in the outdoor heat exchanger (76) to evaporate. Then, the refrigerant having evaporated in the outdoor heat exchanger (76) is sucked into the compressor (30) and compressed again therein.

Effects of Embodiment 1

Since in Embodiment 1 the heat exchangers (48) are connected in parallel with each other in the refrigerant circuit (80), the respective mean values of temperatures of air heated by the heat exchangers (48) are relatively close to each other. In other words, the respective temperatures of air having passed through the heat exchangers (48) are approximately equal to each other. Therefore, the respective temperatures of supply air through the air outlets (23) can be approximately equal to each other. Specifically, it can be avoided that the temperature of air having passed through the heat exchange part (38) gradually changes along the perimeter of the heat exchanger part (38) as has been done in the past and it can be reduced that the temperature of supply air varies depending on the air outlets (23). Furthermore, it can be reduced that the temperature of supply air to which persons in the room are exposed varies depending on location in the room, which enhances the comfortability of the persons in the room.

Furthermore, in Embodiment 1, the degree of temperature drop per single forward and backward travel between one end and the other end of the heat exchanger (48) is reduced as compared to the case where the refrigerant flow path (45) is formed to traverse back and forth only once between one end and the other end of the heat exchanger (48). Therefore, in terms of per single forward and backward travel of refrigerant, the temperature difference of refrigerant between one end and the other end of the heat exchanger (48) is reduced. Thus, the temperature difference between air heated at one end of the heat exchanger (48) and air heated at the other end thereof is reduced. Hence, it can be reduced that the temperature of supply air varies depending on the air outlets (23).

Furthermore, in Embodiment 1, high-temperature refrigerant flows through the side of the refrigerant flow path (45) near the inlet port and away from the indoor fan (39) and low-temperature refrigerant flows through the side thereof near the outlet port and towards the indoor fan (39). Therefore, even after being heated by the side of the heat exchanger (48) towards the indoor fan (39), air passing through the heat exchanger (48) can keep a temperature difference from refrigerant flowing through the side of the heat exchanger (48) away from the indoor fan (39). Thus, the amount of heat exchange between air and refrigerant on the side of the heat exchanger (48) away from the indoor fan (39) becomes relatively large. This increases the amount of heat exchange between air and refrigerant in the heat exchanger (48), which enhances the operating efficiency of the air conditioner.

Furthermore, in Embodiment 1, the respective mean values of temperatures of air heated by both the refrigerant flow paths (45) of each heat exchanger (48) are relatively close to each other. Therefore, out of air flows having passed through one heat exchanger (48), air flows having passed through different refrigerant flow paths (45) have a relatively small temperature difference. Hence, it can be reduced that the temperature of air having passed through the heat exchanger (48) varies depending on location in the heat exchanger (48) where the air has passed.

Furthermore, in Embodiment 1, there is no need to bend the heat exchanger (48) as has been done in the past. In a supercritical refrigeration cycle, generally, the high-side pressure of the refrigeration cycle is much higher than that in a normal refrigeration cycle. Therefore, a thick heat exchanger tube is used for a heat exchanger (48) for use in the supercritical refrigeration cycle. This makes the bending work of the heat exchanger (48) difficult when the heat exchanger (48) is formed in a hollow square shape as has been done in the past. Unlike the above, in Embodiment 1, there is no need to bend the heat exchanger (48). Therefore, the heat exchange part (38) can be easily formed.

Modification of Embodiment 1

Figure 6:
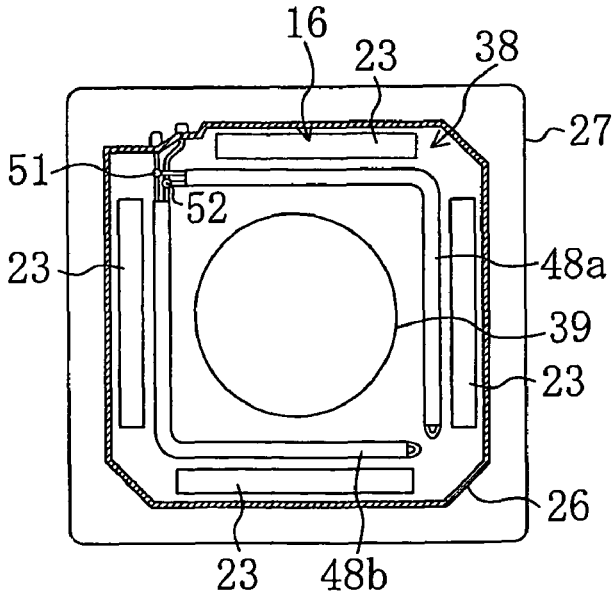
FIG. 6 is a plan view of the interior of an indoor unit of an air conditioner according to a modification of Embodiment 1 of the present invention.

A modification of Embodiment 1 will be described. In this modification, as shown in FIG. 6, the heat exchange part (38) is composed of two heat exchangers (48) each formed in the shape of the letter L when viewed in the axial direction of the indoor fan (39).

Specifically, each heat exchanger (48) is formed in the shape of the letter L by bending it at a single point. The two heat exchangers (48*a*, 48*b*) are connected in parallel with each other in the refrigerant circuit (80). Each heat exchanger (48) has two flat plate parts each formed like a flat plate and a curved plate part formed between both the flat plate parts. Each heat exchanger (48) is disposed so that its flat plate parts extend along the side surfaces of the casing body (26). Thus, one of the two heat exchangers (48) covers two of the four sides of the indoor fan (39) and the other heat exchanger (48) covers the remaining two sides thereof. Furthermore, the flat plate parts of the heat exchangers (48) extend, one along each air outlet (23).

In Embodiment 1, since the high-side pressure of the refrigeration cycle is higher than that of a refrigeration cycle in which CFC is used as refrigerant, relatively thick U-shaped heat exchanger tubes of about 1 mm thickness (diameter: 7 mm) are used. On the other hand, in using CFC as refrigerant, U-shaped heat exchanger tubes of about 0.3 mm thickness (diameter: 7 mm) are used. Therefore, in Embodiment 1, it is difficult to reduce the bend radius of a bent portion of each heat exchanger (48) (the bend radius of a portion of the heat exchanger (48) bent to form the heat exchanger (48) in the shape of the letter L). In this embodiment, the bend radius is set at about 80 mm. On the other hand, in U-shaped heat exchanger tubes used with CFC refrigerant, their bend radius is normally set at about 50 mm.

Figure 7:
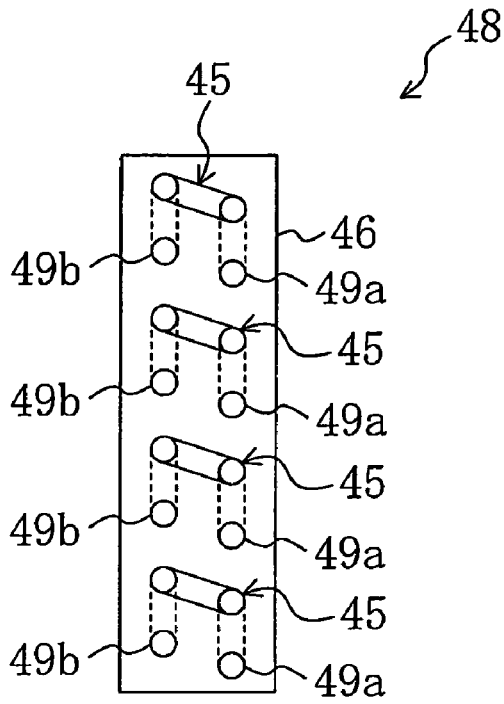
FIG. 7 is a front view of an end of a heat exchanger near refrigerant ports thereof in an indoor unit of an air conditioner according to a modification of Embodiment 1 of the present invention.

Each heat exchanger (48) is, as shown in FIG. 7, provided with four refrigerant flow paths (45, 45). In each heat exchanger (48), the four refrigerant flow paths (45, 45) are connected in parallel with each other. Furthermore, in each heat exchanger (48), the four refrigerant flow paths (45, 45) are alongside each other in the axial direction of the indoor fan (39).

Each refrigerant flow path (45) is formed by connecting two U-shaped heat exchanger tubes. Each refrigerant flow path (45) meanders back and forth twice between one end and the other end of the heat exchanger (48). Specifically, each refrigerant flow path (45) is formed by inserting a single U-shaped heat exchanger tube in each of one lateral end and the other lateral end portions of each fin (46) of the heat exchanger (48) to vertically align its straight tube parts with each other and then connecting the upper end of the U-shaped heat exchanger tube at the one lateral end portions of the fins (46) and the upper end of the U-shaped heat exchanger tube at the other lateral end portions thereof by a semi-circular heat exchanger tube.

One of the four corners of the casing body (26) is provided with one header (51) and one flow divider (52). A refrigerant pipe extending from the header (51) is connected to a gas-side connection port (not shown) formed in a side surface of the casing body (26). A refrigerant pipe extending from the flow divider (52) is connected to a liquid-side connection port (not shown) formed in a side surface of the casing body (26).

Each heat exchanger (48) is disposed so that its end having refrigerant ports faces the header (51) and the flow divider (52). In each of the four refrigerant flow paths (45, 45) of each heat exchanger (48), the refrigerant port in one lateral end portion of the fin is connected to the header (51) and the refrigerant port in the other lateral end portion thereof is connected to the flow divider (52). Furthermore, each heat exchanger (48) is disposed so that the one lateral end portions of the fins (46) are located away from the indoor fan (39) and the other lateral end portions thereof are located towards the indoor fan (39).

According to this modification, the temperatures of air flows having passed through two sides of the L-shapes of the two heat exchangers (48) located towards the refrigerant ports (49*a*, 49*b*) and blown out through the associated air outlets (23) are relatively close to each other and the temperatures of air flows having passed through the remaining two sides thereof located towards the halfway points and blown out through the associated air outlets (23) are also relatively close to each other. In other words, out of the four air outlets (23), the temperatures of supply air through two air outlets (23) are relatively close to each other and the temperatures of supply air through the remaining two air outlets (23) are relatively close to each other. Therefore, the temperature of supply air does not significantly vary among the four air outlets (23) unlike the conventional air conditioners. Hence, it can be reduced that the temperature of supply air varies depending on the air outlets (23).

Embodiment 2 of the Invention

Embodiment 2 of the present invention will be described. Embodiment 2 is an indoor unit (10) of an air conditioner according to the present invention. A description is given below of different points from Embodiment 1.

Figure 8:
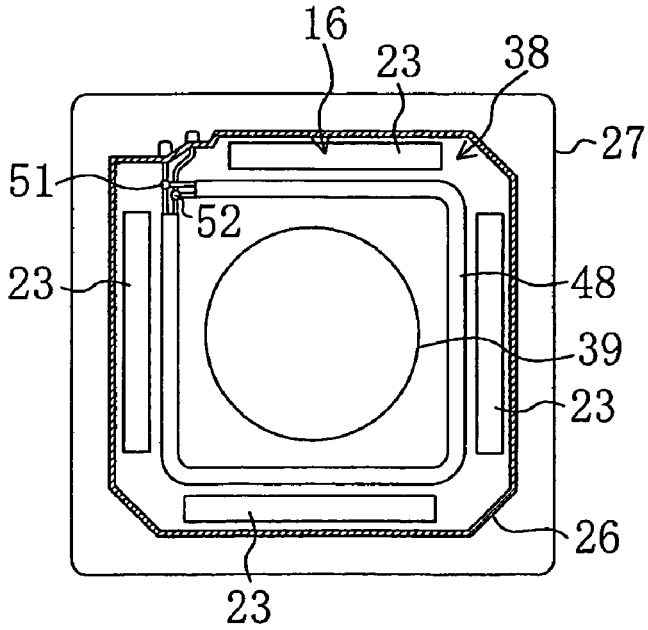
FIG. 8 is a plan view of the interior of an indoor unit of an air conditioner according to Embodiment 2 of the present invention.

In Embodiment 2, as shown in FIG. 8, the heat exchange part (38) is composed of a single heat exchanger (48) formed in a hollow square shape in plan view. The heat exchanger (48) is disposed to surround all four sides of the indoor fan (39). The heat exchanger (48) uses, like the modification of Embodiment 1, U-shaped heat exchanger tubes of about 1 mm thickness (diameter: 7 mm). In three bent portions of the heat exchanger (48), the bend radius is set at about 80 mm.

Figure 9:
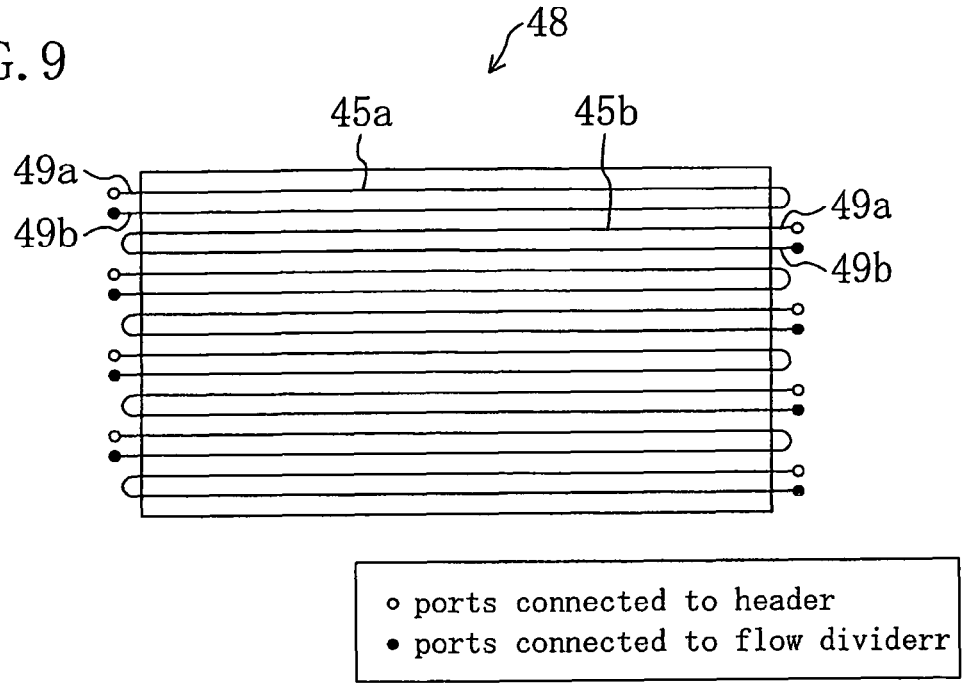
FIG. 9 is a schematic development of a heat exchanger of the indoor unit of the air conditioner according to Embodiment 2 of the present invention, showing the layout of refrigerant flow parts in the heat exchanger.
Figure 10:
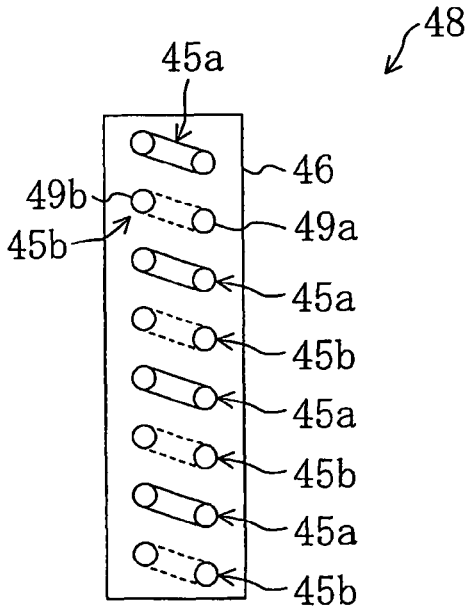
FIG. 10 is a front view of one of both ends of the heat exchanger of the indoor unit of the air conditioner according to Embodiment 2 of the present invention.

The heat exchanger (48) has, as shown in FIGS. 9 and 10, eight refrigerant flow paths (45, 45, . . . ) formed to extend in the direction of the perimeter of the heat exchange part (38). The eight refrigerant flow paths (45) are connected in parallel with each other in the refrigerant circuit (80). Furthermore, the eight refrigerant flow paths (45) are arranged along the axial direction of the indoor fan (39). In Embodiment 2, the heat exchange part (38) includes a single region in which a plurality of refrigerant flow paths (45) parallel-connected in the refrigerant circuit (80) are arranged along the axial direction of the indoor fan (39) (hereinafter, referred to as a "parallel path arrangement region"). The parallel path arrangement region is a region from one end to the other end of the heat exchanger (48). All the refrigerant flow paths (45) in the parallel path arrangement region are formed in a single heat exchanger (48).

Each refrigerant flow path (45) is formed by a single U-shaped heat exchanger tube. Each refrigerant flow path (45) is disposed with its straight tube parts offset from each other with respect to the longitudinal direction of the fins (46). In each refrigerant flow path (45), one of the ports (49*a*, 49*b*) is located in a portion of a fin (46) located towards the indoor fan (39) (in the inner side of the heat exchanger (48)) and the other port (49*a*, 49*b*) is located in a portion thereof located away from the indoor fan (39) (in the outer side of the heat exchanger (48)).

In the heat exchanger (48), four of the eight refrigerant flow paths (45) constitute first flow paths (45*a*) having their ports (49*a*, 49*b*) at one end of the heat exchanger (48) and the remaining four refrigerant flow paths (45) constitute second flow paths (45*b*) having their ports (49*a*, 49*b*) at the other end of the heat exchanger (48). The first flow path (45*a*) and the second flow path (45*b*) are opposite from each other in the direction of inflow of refrigerant during the heating operation with respect to the direction of the perimeter of the heat exchange part (38). Thus, the parallel path arrangement region is constituted by a single heat exchanger (48) in which the first flow paths (45*a*) having their refrigerant inlet ports during the heating operation at one end of the heat exchanger (48) and the second flow paths (45*b*) having their inlet ports during the heating operation at the other end thereof are formed. In the parallel path arrangement region, the first flow paths (45*a*) and the second flow paths (45*b*) are formed in equal numbers. In the parallel path arrangement region, the first flow paths (45*a*) and the second flow paths (45*b*) are alternated in the axial direction of the indoor fan (39).

Each fin (46) of the heat exchanger (48) has slits (not shown) formed, each slit between each pair of adjacent first flow path (45*a*) and second flow path (45*b*). The reason for the formation of slits in the fins (46) is that a large temperature difference is found between the first flow paths (45*a*) and the second flow paths (45*b*) in the fin (46) through which respective portions of the first flow paths (45*a*) near their refrigerant inlet ports and respective portions of the second flow paths (45*b*) near their refrigerant outlet ports pass and the fin (46) through which respective portions of the first flow paths (45*a*) near their refrigerant outlet ports and respective portions of the second flow paths (45*b*) near their refrigerant inlet ports pass and, therefore, it is necessary to restrain increase in the amount of heat exchange between refrigerant flowing through the first flow paths (45*a*) and refrigerant flowing through the second flow paths (45*b*).

One of the four corners of the casing body (26) is provided with a header (51) and a flow divider (52). Four refrigerant pipes extend from the header (51) to each of the one end and the other end of the heat exchanger (48). The refrigerant pipes extending from the header (51) to the one end of the heat exchanger (48) are connected to the outer ports (49*a*, 49*b*) of the first flow paths (45*a*). The refrigerant pipes extending from the header (51) to the other end of the heat exchanger (48) are connected to the outer ports (49*a*, 49*b*) of the second flow paths (45*b*). On the other hand, four refrigerant pipes extend from the flow divider (52) to each of the one end and the other end of the heat exchanger (48). The refrigerant pipes extending from the flow divider (52) to the one end of the heat exchanger (48) are connected to the inner ports (49*a*, 49*b*) of the first flow paths (45*a*). The refrigerant pipes extending from the flow divider (52) to the other end of the heat exchanger (48) are connected to the inner ports (49*a*, 49*b*) of the second flow paths (45*b*). In each refrigerant flow path (45), the inlet end thereof during the heating operation is disposed away from the indoor fan (39) and the outlet end thereof is disposed towards the indoor fan (39).

In Embodiment 2, during the heating operation, refrigerant having flowed into the header (51) is distributed to the four first flow paths (45*a*) and the four second flow paths (45*b*). In each first flow path (45*a*), the refrigerant having flowed therein from the one end of the heat exchanger (48) flows through the outer straight tube part when viewed in the transverse direction of the fins (46), turns back at the other end of the heat exchanger (48), then flows through the inner straight tube part and then returns to the one end of the heat exchanger (48). In each second flow path (45*b*), the refrigerant having flowed therein from the other end of the heat exchanger (48) flows through the outer straight tube part, turns back at the one end of the heat exchanger (48), then flows through the inner straight tube part and then returns to the other end of the heat exchanger (48). In each flow path (45*a*, 45*b*) during the heating operation, at its end having the inlet and outlet ports, a relatively large temperature difference is created between air heated by the inner side of the heat exchanger (48) and refrigerant flowing through the outer side thereof and, therefore, the air having passed through the heat exchanger (48) reaches a relatively high temperature.

Effects of Embodiment 2

In Embodiment 2, high-temperature refrigerant flows just after flowing into the refrigerant flow paths (45) flow at both ends of the parallel path arrangement region during the heating operation. In this relation, in the conventional case where in the parallel path arrangement region during the heating operation all the refrigerant flow paths (45) have the same direction of inflow of refrigerant, high-temperature refrigerant flows during the heating operation flow only at one of both ends of the parallel path arrangement region. Thus, during the heating operation, a relatively large temperature difference is found between air having passed through the one end of the parallel path arrangement region and air having passed through the other end thereof and, therefore, the temperature of supply air varies depending on location in the air supply part (16). Unlike the above, in Embodiment 2, since high-temperature refrigerant flows just after flowing into the refrigerant flow paths (45) flow at both ends of the parallel path arrangement region, a less temperature difference is found between air having passed through one end of the parallel path arrangement region and air having passed through the other end thereof. Therefore, it can be reduced that the temperature of supply air varies depending on location in the air supply part (16). In addition, it can be reduced that the temperature of supply air to which persons in the room are exposed varies depending on location in the room, which enhances the comfortability of the persons in the room.

Furthermore, in Embodiment 2, one end and the other end of the parallel path arrangement region have equal numbers of refrigerant inlet ports of the first or second flow paths (45*a*, 45*b*) during the heating operation. Therefore, the temperature difference between air having passed through one end of the parallel path arrangement region and air having passed through the other end thereof can be further reduced, which reduces variation in the temperature of supply air depending on location in the air supply part (16).

Furthermore, in Embodiment 2, at each end of the parallel path arrangement region, the refrigerant flow paths (45) whose refrigerant inlet ports during the heating operation are at the end of the parallel path arrangement region and the refrigerant flow paths (45) whose refrigerant inlet ports during the heating operation are not at the end thereof are alternated along the axial direction of the indoor fan (39). Therefore, during the heating operation, at each end of the parallel path arrangement region, relatively high-temperature air having passed around the refrigerant flow paths (45) whose refrigerant inlet ports are at the end of the parallel path arrangement region is easily mixed with less high-temperature air having passed around the refrigerant flow paths (45) whose refrigerant inlet ports are not at the end thereof, which makes the temperature of supply air uniform.

Modification 1 of Embodiment 2

Figure 11:
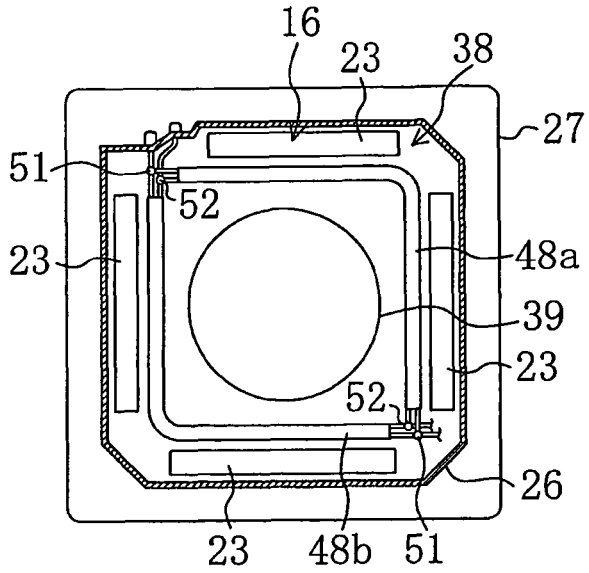
FIG. 11 is a plan view of the interior of an indoor unit of an air conditioner according to Modification 1 of Embodiment 2 of the present invention.

Modification 1 of Embodiment 2 will be described. The heat exchange part (38) in Modification 1 is, as shown in FIG. 11, composed of two heat exchangers (48) each formed in the shape of the letter L when viewed in the axial direction of the indoor fan (39). The two heat exchangers (48) are disposed to face each other with the indoor fan (39) interposed therebetween.

Figure 12:
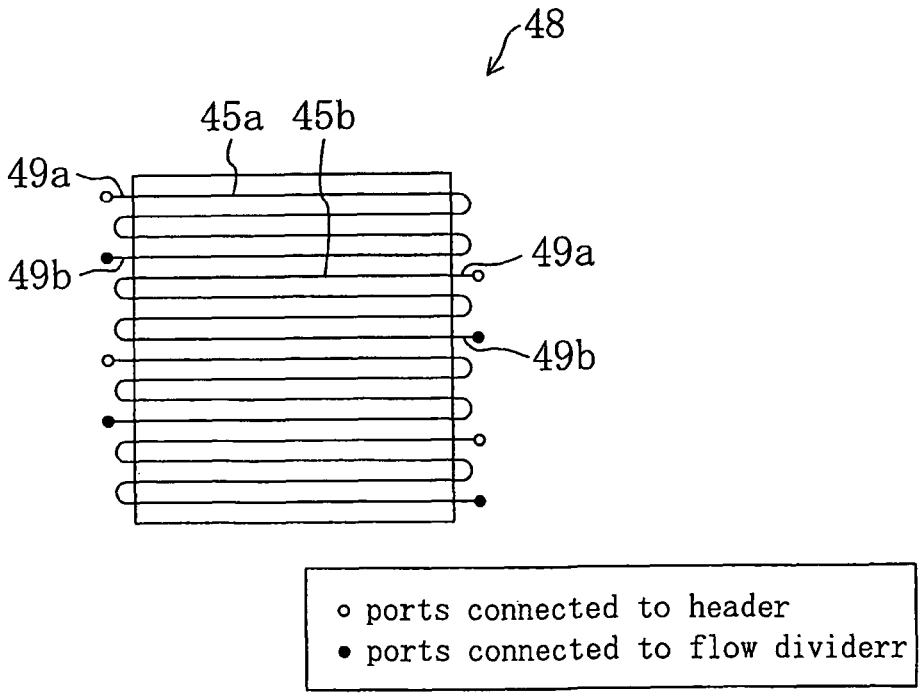
FIG. 12 is a schematic development of a heat exchanger of the indoor unit of the air conditioner according to Modification 1 of Embodiment 2 of the present invention, showing the layout of refrigerant flow parts of the heat exchanger.
Figure 13:
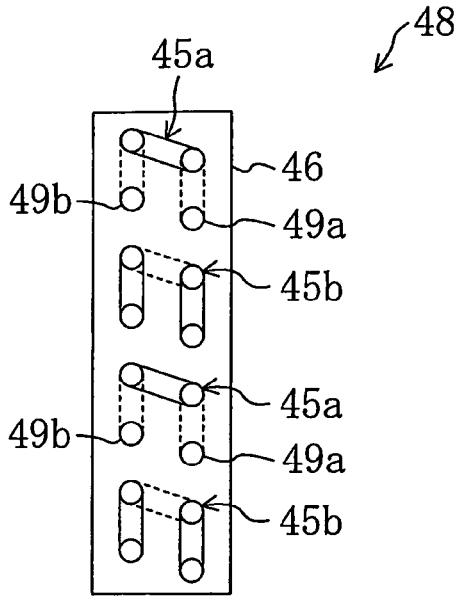
FIG. 13 is a front view of one of both ends of the heat exchanger of the indoor unit of the air conditioner according to Modification 1 of Embodiment 2 of the present invention.

Each heat exchanger (48) has, as shown in FIGS. 12 and 13, four refrigerant flow paths (45, 45, . . . ) formed to extend in the direction of the perimeter of the heat exchange part (38). The four refrigerant flow paths (45) are connected in parallel with each other in the refrigerant circuit (80). Furthermore, the four refrigerant flow paths (45) are arranged along the axial direction of the indoor fan (39). In Modification 1, the heat exchange part (38) includes two parallel path arrangement regions in each of which a plurality of refrigerant flow paths (45) parallel-connected in the refrigerant circuit (80) are arranged along the axial direction of the indoor fan (39). Each parallel path arrangement region is a region from one end to the other end of the heat exchanger (48). All the refrigerant flow paths (45) in each parallel path arrangement region are formed in a single heat exchanger (48). Each refrigerant flow path (45) is, like the modification of Embodiment 1, formed by connecting two U-shaped heat exchanger tubes.

In each heat exchanger (48), two of the four refrigerant flow paths (45) constitute first flow paths (45*a*) having their ports (49*a*, 49*b*) at one end of the heat exchanger (48) and the remaining two refrigerant flow paths (45) constitute second flow paths (45*b*) having their ports (49*a*, 49*b*) at the other end of the heat exchanger (48). The first flow path (45*a*) and the second flow path (45*b*) are opposite from each other in the direction of inflow of refrigerant during the heating operation with respect to the direction of the perimeter of the heat exchange part (38). In each parallel path arrangement region, the first flow paths (45*a*) and the second flow paths (45*b*) are formed in equal numbers. In each parallel path arrangement region, the first flow paths (45*a*) and the second flow paths (45*b*) are alternated in the axial direction of the indoor fan (39).

Out of the four corners of the casing body (26), two in a diagonal relationship are each provided with one header (51) and one flow divider (52). The two heat exchangers (48*a*, 48*b*) are disposed so that their ends having the ports (49*a*, 49*b*) of the first flow paths (45*a*) face one pair of header (51) and flow divider (52) located at one of the corners and that their ends having the ports (49*a*, 49*b*) of the second flow paths (45*b*) face the other pair of header (51) and flow divider (52) located at another corner. The first flow paths (45*a*) are connected to the one pair of header (51) and flow divider (52) located at the one corner. The second flow paths (45*b*) are connected to the other pair of header (51) and flow divider (52) located at the other corner. In each refrigerant flow path (45), the header (51) is connected to the port (49*a*, 49*b*) away from the indoor fan (39) and the flow divider (52) is connected to the port (49*a*, 49*b*) towards the indoor fan (39).

In Modification 1, during the heating operation, refrigerant having flowed into one of the headers (51) is distributed to the two heat exchangers (48*a*, 48*b*) and further distributed in each heat exchanger (48*a*, 48*b*) to the two first flow paths (45*a*). Furthermore, refrigerant having flowed into the other header (51) is also distributed to the two heat exchangers (48*a*, 48*b*) and further distributed in each heat exchanger (48*a*, 48*b*) to the two second flow paths (45*b*). In the first flow paths (45*a*) of each heat exchanger (48), the refrigerant having flowed therein through one end of the heat exchanger (48) travels back and forth twice between the one end and the other end thereof and then flows through the refrigerant pipe extending from the one end thereof into the flow divider (52). In the second flow paths (45*b*), the refrigerant having flowed therein through the other end of the heat exchanger (48) travels back and forth twice between the one end and the other end thereof and then flows through the refrigerant pipe extending from the other end thereof into the flow divider (52).

Modification 2 of Embodiment 2

Figure 14:
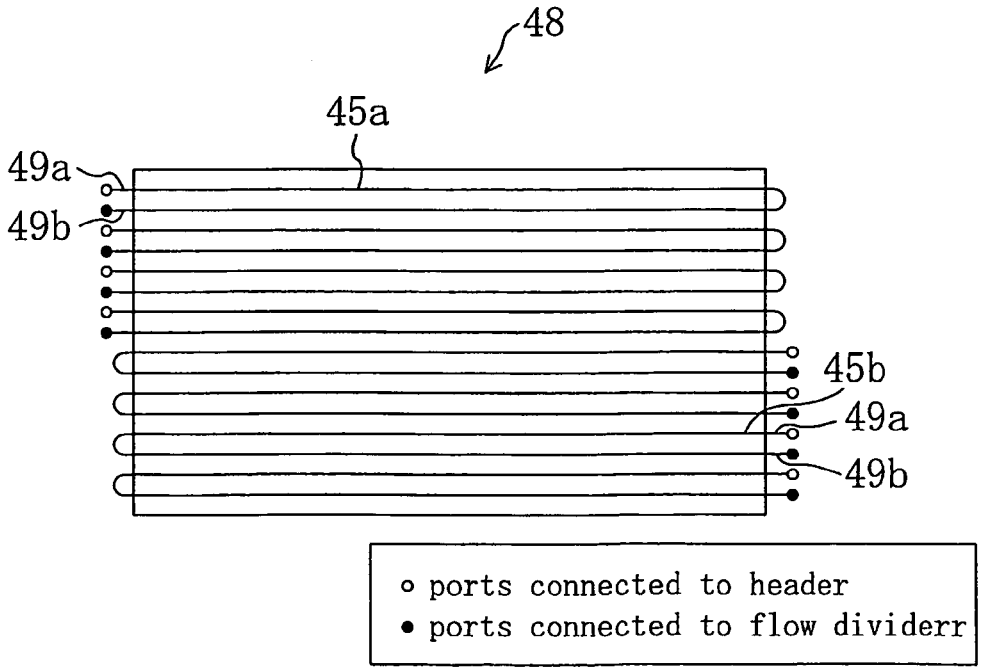
FIG. 14 is a schematic development of a heat exchanger of an indoor unit of an air conditioner according to Modification 2 of Embodiment 2 of the present invention, showing the layout of refrigerant flow parts of the heat exchanger.

Modification 2 of Embodiment 2 will be described. In the heat exchanger (48) of Modification 2, as shown in FIG. 14, the first flow paths (45*a*) are disposed towards one axial end of the indoor fan (39) (towards the upper end in FIG. 14) and the second flow paths (45*b*) are disposed towards the other axial end of the indoor fan (39) (towards the lower end in FIG. 14).

In Modification 2, like Embodiment 2, the heat exchange part (38) is composed of a single heat exchanger (48) formed in a hollow square shape in plan view. However, like Modification 1 of Embodiment 2, the heat exchange part (38) may be composed of L-shaped heat exchangers (48*a*, 48*b*).

In Modification 2, the first flow paths (45*a*) are collectively disposed in one side of the heat exchanger (48) in the axial direction of the indoor fan (39) and the second flow paths (45*b*) are collectively disposed in the other side of the heat exchanger (48) in the axial direction of the indoor fan (39).

Generally, in producing a heat exchanger (48), each fin (46) is punched by press working to form an approximately cylindrical part protruding from one side of the fin (46) (a so-called fin collar). Thus, the cylindrical part has a form in which the root end portion thereof expands as it approaches the root end. The cylindrical part is formed to expand towards the side of the fin (46) from which a U-shaped heat exchanger tube is inserted. Therefore, if the first flow paths (45*a*) and the second flow paths (45*b*) are alternated in the axial direction of the indoor fan (39) as in Embodiment 2, cylindrical parts protruding from one side of the fin (46) and cylindrical parts protruding from the other side of the fin (46) must be formed to be alternated in the axial direction of the indoor fan (39), which complicates the work of forming cylindrical parts.

Unlike the above case, in this modification, the refrigerant flow paths (45) of each type are collectively disposed. Therefore, the cylindrical parts protruding from one side of the fin (46) and the cylindrical parts protruding from the other side thereof are collected to the upper and lower halves, respectively, of the fin (46), which facilitates the work of forming cylindrical parts on the fin (46).

Modification 3 of Embodiment 2

Figure 15:
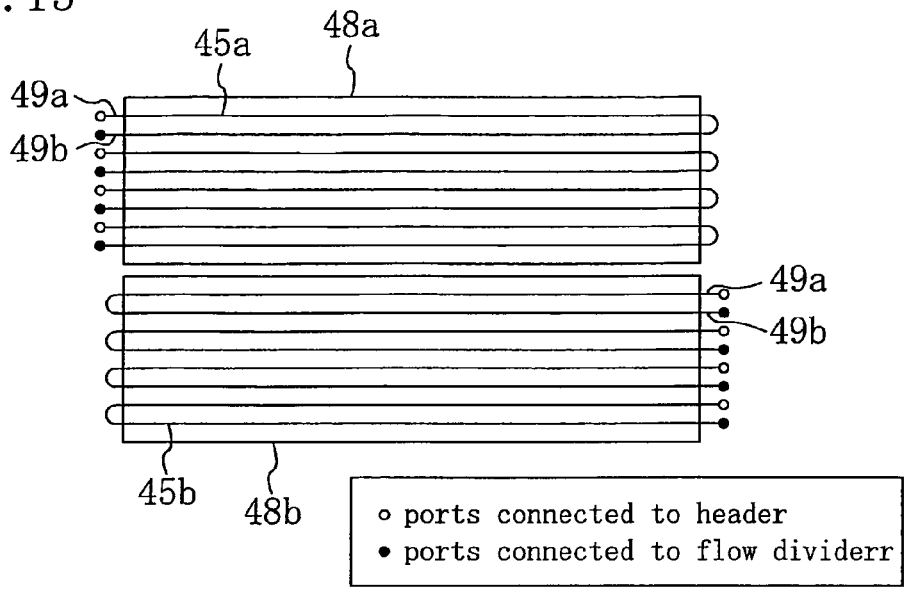
FIG. 15 is a schematic layout diagram of refrigerant flow paths in a heat exchange part of an indoor unit of an air conditioner according to Modification 3 of Embodiment 2 of the present invention.

Modification 3 of Embodiment 2 will be described. In Modification 3, as shown in FIG. 15, the heat exchange part (38) is composed of two heat exchangers, i.e., a first heat exchanger (48*a*) having only first flow paths (45*a*) formed therein and a second heat exchanger (48*b*) having only second-flow paths (45*b*) formed therein. The first heat exchanger (48*a*) has four first flow paths (45*a*) formed therein. The second heat exchanger (48*b*) has four second flow paths (45*b*) formed therein. The first heat exchanger (48*a*) and the second heat exchanger (48*b*) are disposed adjacent each other in the axial direction of the indoor fan (39).

Figure 16:
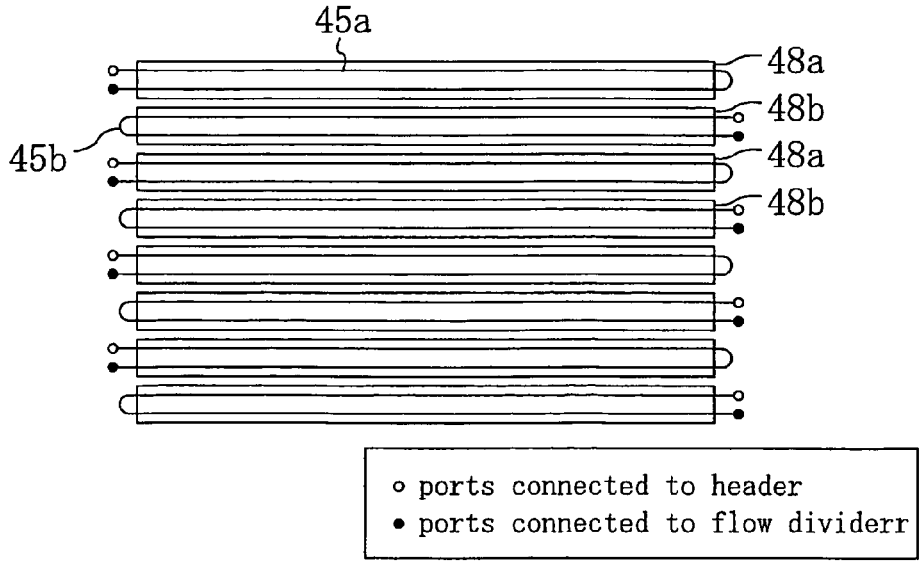
FIG. 16 is a schematic layout diagram showing another layout of refrigerant flow paths in the heat exchange part of the indoor unit of the air conditioner according to Modification 3 of Embodiment 2 of the present invention.

As shown in FIG. 16, the heat exchange part (38) may be composed of eight heat exchangers (48, 48, . . . ) equal in number to the refrigerant flow paths (45). The eight heat exchangers (48, 48, . . . ) are disposed so that first heat exchangers (48*a*) and second heat exchangers (48*b*) are alternated in the axial direction of the indoor fan (39).

In Modification 3, the first flow path (45*a*) and the second flow paths (45*b*) are formed in different heat exchangers (48*a*, 48*b*) of the heat exchange part (38). If the first flow path (45*a*) and the second flow path (45*b*) are formed in the same heat exchanger (48), two types of refrigerant flow paths (45) must be formed in a single heat exchanger (48), which complicates the process of producing the heat exchanger (48). In contrast, in Modification 3, since the first flow path (45*a*) and the second flow path (45*b*) are formed in different heat exchangers (48*a*, 48*b*), a single type of refrigerant flow path (45) is formed in each heat exchanger (48*a*, 48*b*), which avoids complication of the process of producing each heat exchanger (48*a*, 48*b*).

Other Embodiments

The above embodiments may be configured as in the following modifications.

Figure 17:
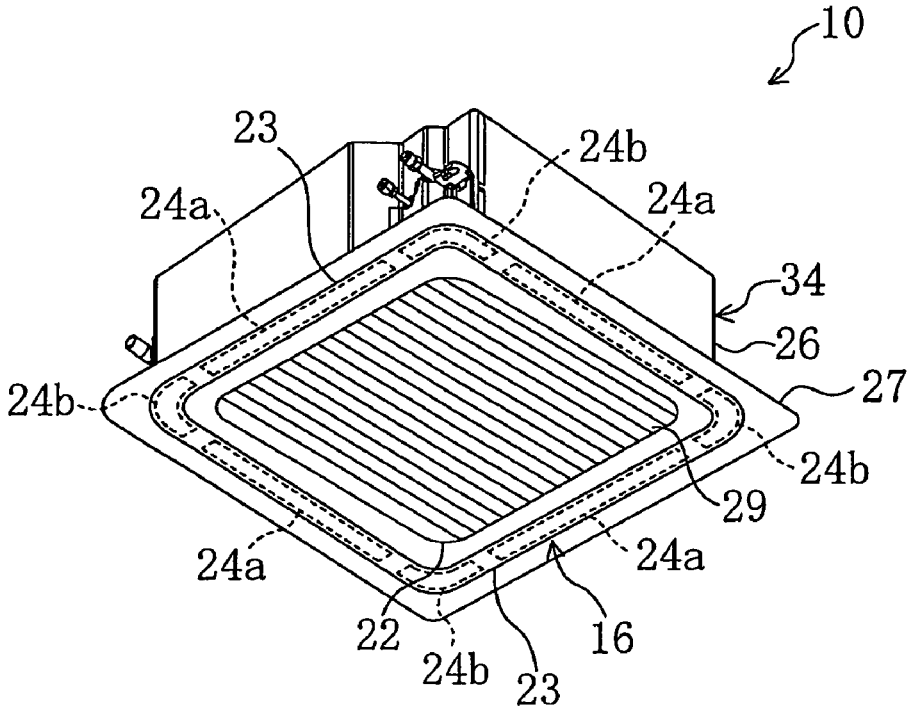
FIG. 17 is a perspective view of an indoor unit of an air conditioner according to another embodiment when viewed from a room.
Figure 18:
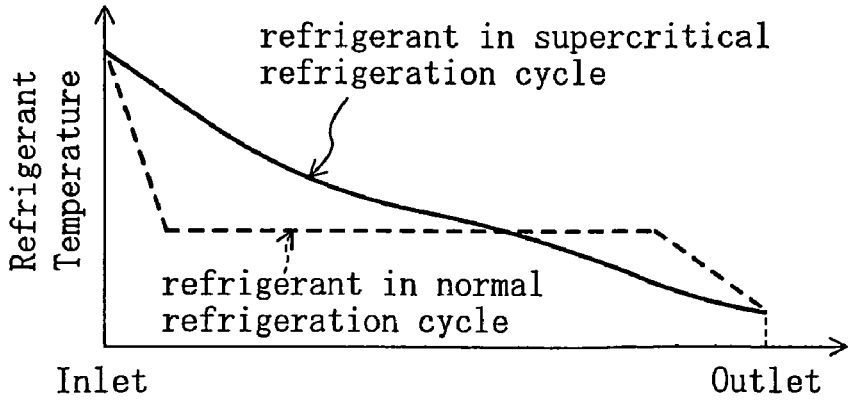
FIG. 18 is a graph showing respective temperature changes of refrigerant in high-pressure side heat exchangers in a supercritical cycle and a normal refrigeration cycle.
Figure 19:
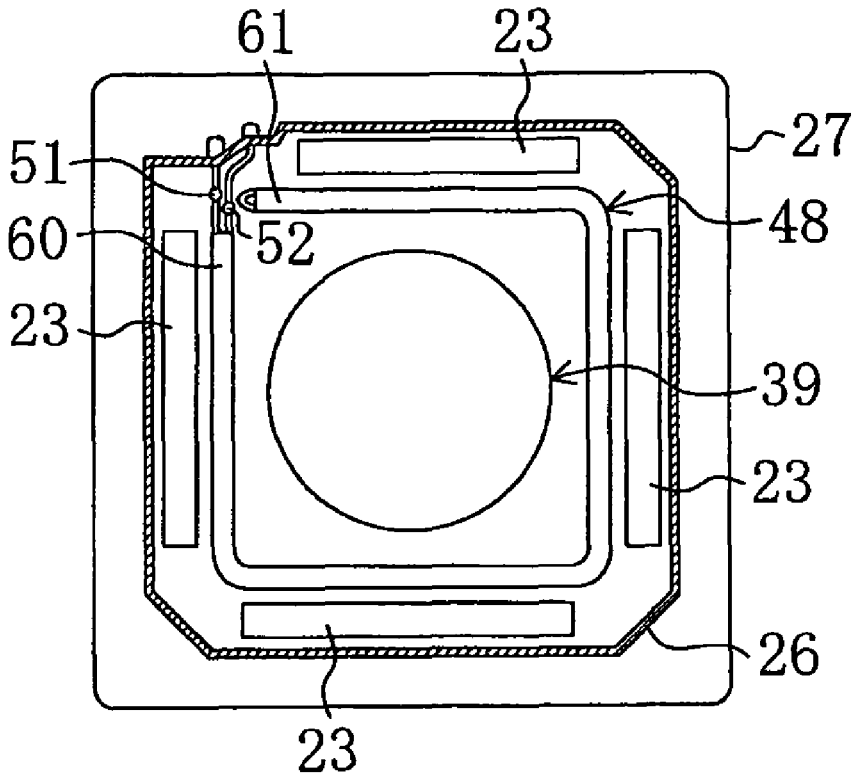
FIG. 19 is a plan view of the interior of an indoor unit of a conventional air conditioner.

In the above embodiments, as shown in FIG. 17, the air supply part (16) may be composed of a single air outlet (23) formed along the entire perimeter of the heat exchange part (38). In this case, four main air supply passages (24*a*) and four sub air supply passages (24*b*) are formed upstream of the air outlet (23) in the casing (34). The main air supply passages (24*a*) are formed, one along each side of the casing (34). The sub air supply passages (24*b*) are formed, one at each of the corners of the casing (34). In this embodiment, the indoor unit (10) has a wider air supply area than that in which the air supply part (16) formed along the perimeter of the heat exchange part (38) is divided into four air outlets (23), one along each side of the bottom of the casing (34). Thus, the wind speed of air supplied through the air outlet (23) can be reduced, which reduces the sound of air supply and thereby enhances the comfortability of persons in the room in terms of quietness. Furthermore, the wind speed of air which is supplied through the air outlet (23) and to which persons in the room are exposed can be reduced, which enhances the comfortability of persons in the room also in terms of feeling of draft.

The above embodiments are merely preferred embodiments in nature and are not intended to limit the scope, applications and use of the invention.

INDUSTRIAL APPLICABILITY

As can be seen from the above, the present invention is useful for air conditioner indoor units in which an air supply part for supplying air therethrough to a room in different directions is formed.

The invention claimed is:

1. An indoor unit for an air conditioner, the indoor unit comprising:

an indoor fan for sucking air in an axial direction thereof and radially blowing out the air;

a heat exchange part, connected in a refrigerant circuit and disposed to surround the indoor fan, for exchanging heat between the air blown out of the indoor fan and refrigerant in the refrigerant circuit; and a casing containing the indoor fan and the heat exchange part and having an air supply part formed therein to supply air to a room in different directions, wherein the refrigerant circuit is operable in a refrigeration cycle in which the high-side pressure is equal to or above the critical pressure of the refrigerant, the indoor unit is capable of performing a heating operation in which the heat exchange part serves as a gas cooler in the refrigerant circuit, the heat exchange part includes a plurality of heat exchangers separated from each other along a direction of the perimeter of the heat exchange part and connected in parallel with each other in the refrigerant circuit, and the heat exchange part includes four heat exchangers each formed in the shape of a panel.

2. The indoor unit for an air conditioner of claim 1, wherein each of the heat exchangers constituting the heat exchange part includes a refrigerant flow path framed therein to meander back and forth a plurality of times between one end and the other end of the heat exchanger.

3. The indoor unit for an air conditioner of claim 2, wherein each of the heat exchangers includes a plurality of the refrigerant flow paths connected in parallel with each other.

4. The indoor unit for an air conditioner of claim 2, wherein each of the heat exchangers includes a plurality of the refrigerant flow paths arranged in the axial direction of the indoor fan.

5. The indoor unit for an air conditioner of claim 1, wherein a refrigerant flow path is formed in the heat exchange part so that an inlet end thereof during the heating operation is located in the side of the heat exchange part away from the indoor fan and an outlet end thereof during the heating operation is located in the side of the heat exchange part towards the indoor fan.

6. The indoor unit for an air conditioner of claim 1, wherein the air supply part includes four air outlets, one formed along each of the heat exchangers, and the air supply part is configured to supply through each of the air outlets air having passed through the heat exchanger located along the air outlet.

7. The indoor unit for an air conditioner of claim 1, wherein the refrigerant circuit is filled with carbon dioxide as the refrigerant.

8. The indoor unit for an air conditioner of claim 1, wherein the air supply part includes a single air outlet formed along the entire perimeter of the heat exchange part.

9. An indoor unit for an air conditioner, the indoor unit comprising:

an indoor fan for sucking air in an axial direction thereof and radially blowing out the air;

a heat exchange part, connected in a refrigerant circuit and disposed to surround the indoor fan, for exchanging heat between the air blown out of the indoor fan and refrigerant in the refrigerant circuit; and a casing containing the indoor fan and the heat exchange part and having an air supply part formed therein to supply air to a room in different directions, wherein the refrigerant circuit is operable in a refrigeration cycle in which the high-side pressure is equal to or above the critical pressure of the refrigerant, the indoor unit is capable of performing a heating operation in which the heat exchange part serves as a gas cooler in the refrigerant circuit, the heat exchange part includes a plurality of refrigerant flow paths connected in parallel with each other in the refrigerant circuit to extend in a direction of the perimeter of the heat exchange part and arranged alongside each other in the axial direction of the indoor fan, and during the heating operation, the direction of refrigerant flowing into a first flow path constituting part of the plurality of refrigerant flow paths is opposite to the direction of refrigerant flowing into a second flow path constituting the remaining part of the plurality of refrigerant flow paths with reference to the direction of the perimeter of the heat exchange part.

10. The indoor unit for an air conditioner of claim 9, wherein the first and second flow paths are formed in equal numbers in the heat exchange part.

11. The indoor unit for an air conditioner of claim 9, wherein in the heat exchange part the first and second flow paths are alternated in the axial direction of the indoor fan.

12. The indoor unit for an air conditioner of claim 9, wherein in the heat exchange part one or more of the first flow paths are disposed towards one axial end of the indoor fan and one or more of the second flow paths are disposed towards the other axial end of the indoor fan.

13. The indoor unit for an air conditioner of claim 9, wherein the heat exchange part includes one or more heat exchangers in which both the first and second flow paths are formed.

14. The indoor unit for an air conditioner of claim 9, wherein the heat exchange part comprises a first heat exchanger having only the first flow path formed therein and a second heat exchanger having only the second flow path formed therein, and in the heat exchange part the first heat exchanger and the second heat exchanger are disposed adjacent each other in the axial direction of the indoor fan.

15. The indoor unit for an air conditioner of claim 9, wherein the heat exchange part includes two heat exchangers each formed in the shape of the letter L when viewed in the axial direction of the indoor fan.

16. The indoor unit for an air conditioner of claim 15, wherein the air supply part includes four air outlets, one formed along each side of the L-shape of each of the L-shaped heat exchangers, and the air supply part is configured to supply through each of the air outlets air having passed through part of the heat exchanger located along the air outlet.

17. The indoor unit for an air conditioner of claim 15, wherein the air supply part includes a single air outlet formed along the entire perimeter of the heat exchange part.

18. The indoor unit for an air conditioner of claim 9, wherein the refrigerant circuit is filled with carbon dioxide as the refrigerant.

19. The indoor unit for an air conditioner of claim 9, wherein the heat exchange part includes four heat exchangers each formed in the shape of a panel.

20. The indoor unit for an air conditioner of claim 19, wherein the air supply part includes a single air outlet formed along the entire perimeter of the heat exchange part.

21. The indoor unit for an air conditioner of claim 19, wherein a refrigerant flow path is formed in the heat exchange part so that an inlet end thereof during the heating operation is located in the side of the heat exchange part away from the indoor fan and an outlet end thereof during the heating operation is located in the side of the heat exchange part towards the indoor fan.

22. The indoor unit for an air conditioner of claim 19, wherein the air supply part includes four air outlets, one formed along each of the heat exchangers, and the air supply part is configured to supply through each of the air outlets air having passed through the heat exchanger located along the air outlet.

* * * * *